US009126102B2

(12) United States Patent
Snow et al.

(10) Patent No.: US 9,126,102 B2
(45) Date of Patent: Sep. 8, 2015

(54) FOUR-CARD POKER GAME WITH VARIABLE WAGER

(71) Applicant: Bally Gaming, Inc., Las Vegas, NV (US)

(72) Inventors: Roger M. Snow, Las Vegas, NV (US); Louis J. Castle, II, Las Vegas, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 36 days.

(21) Appl. No.: 14/034,287

(22) Filed: Sep. 23, 2013

(65) Prior Publication Data

US 2014/0087805 A1 Mar. 27, 2014

Related U.S. Application Data

(63) Continuation-in-part of application No. 13/631,818, filed on Sep. 28, 2012, which is a continuation-in-part of application No. 11/499,864, filed on Aug. 4, 2006, which is a continuation of application No. 10/152,325, filed on May 20, 2002, now abandoned.

(51) Int. Cl.
*A63F 1/00* (2006.01)
*G07F 17/32* (2006.01)

(52) U.S. Cl.
CPC ..... *A63F 1/00* (2013.01); *G07F 17/326* (2013.01); *G07F 17/3223* (2013.01); *G07F 17/3293* (2013.01)

(58) Field of Classification Search
CPC ..... A63F 1/00
USPC ..... 273/292; 463/13
See application file for complete search history.

(56) References Cited

U.S. PATENT DOCUMENTS 5,324,035 A 6/1994 Morris et al.
5,413,353 A 5/1995 Demarest et al.
5,603,502 A 2/1997 Nagagawa
(Continued)

FOREIGN PATENT DOCUMENTS

CA 2 529 076 A1 6/2006
WO WO 2007/047223 A2 4/2007
(Continued)

OTHER PUBLICATIONS

United States Office Action, U.S. Appl. No. 13/631,818, Apr. 2, 2014, 9 pages.
(Continued)

*Primary Examiner* — Michael Dennis
(74) *Attorney, Agent, or Firm* — TraskBritt

(57) ABSTRACT

An online casino game utilizes at least one deck of playing cards. Each player places an initial wager. A first and a second number of cards are dealt to a dealer and to each player, respectively. The first and second numbers are greater than the number of cards to be used in determining a poker rank hand for the dealer and for each player, respectively. The dealer and each player discard at least one card to form a dealer hand and a player hand, respectively, having an equal number of cards. Each player hand is resolved against the dealer hand according to predetermined game rules. The initial wager must be at least matched with a game wager (play wager), which may be a multiple of the initial wager (e.g., 1× to 5×, at the option of the player), for the player to remain in the game after receiving his cards.

17 Claims, 10 Drawing Sheets

(56) References Cited

U.S. PATENT DOCUMENTS

| | | | | |
|---|---|---|---|---|
| 5,707,286 | A | 1/1998 | Carlson | |
| 5,725,216 | A | 3/1998 | Jones | |
| 5,741,183 | A | 4/1998 | Acres et al. | |
| RE35,864 | E | 7/1998 | Weingardt | |
| 5,830,069 | A | 11/1998 | Soltesz et al. | |
| 5,851,149 | A | 12/1998 | Xidos et al. | |
| 6,142,872 | A | 11/2000 | Walker et al. | |
| 6,210,274 | B1 | 4/2001 | Carlson | |
| 6,272,223 | B1 | 8/2001 | Carlson | |
| 6,279,910 | B1 | 8/2001 | de Keller | |
| 6,325,375 | B1 | 12/2001 | Potter et al. | |
| 6,336,859 | B2 | 1/2002 | Jones et al. | |
| 6,409,602 | B1 | 6/2002 | Wiltshire et al. | |
| 6,533,658 | B1 | 3/2003 | Walker | |
| 6,712,702 | B2 | 3/2004 | Goldberg et al. | |
| 6,749,510 | B2 | 6/2004 | Giobbi | |
| 6,899,628 | B2 | 5/2005 | Leen et al. | |
| 7,056,215 | B1 | 6/2006 | Olive | |
| 7,108,603 | B2 | 9/2006 | Olive | |
| 7,128,652 | B1 | 10/2006 | Lavoie et al. | |
| 7,140,964 | B2 | 11/2006 | Walker | |
| 7,186,181 | B2 | 3/2007 | Rowe | |
| 7,189,161 | B1 | 3/2007 | Wilshire et al. | |
| 7,203,841 | B2 | 4/2007 | Jackson et al. | |
| 7,246,799 | B2 | 7/2007 | Snow | |
| 7,297,062 | B2 | 11/2007 | Gatto et al. | |
| 7,303,473 | B2 | 12/2007 | Rowe | |
| 7,438,295 | B2 | 10/2008 | Aida | |
| 7,510,193 | B1 * | 3/2009 | Schlumbrecht | 273/292 |
| 7,510,478 | B2 | 3/2009 | Benbrahim et al. | |
| 7,515,718 | B2 | 4/2009 | Nguyen et al. | |
| 7,516,959 | B2 | 4/2009 | Huard et al. | |
| 7,537,456 | B2 | 5/2009 | Snow | |
| 7,611,404 | B1 | 11/2009 | Hilf et al. | |
| 7,632,184 | B2 * | 12/2009 | Gauselmann | 463/25 |
| 7,666,095 | B2 | 2/2010 | Van Luchene | |
| 7,744,452 | B2 | 6/2010 | Cimring et al. | |
| 7,780,529 | B2 | 8/2010 | Rowe et al. | |
| 7,794,319 | B2 | 9/2010 | Luciano, Jr. et al. | |
| 7,824,255 | B2 | 11/2010 | Lutnick et al. | |
| 7,846,018 | B2 | 12/2010 | Baerlocher | |
| 7,867,091 | B2 | 1/2011 | Moshal | |
| 7,871,323 | B2 | 1/2011 | Walker et al. | |
| 7,905,770 | B2 | 3/2011 | Snow | |
| 7,909,689 | B2 | 3/2011 | Lardie | |
| 7,931,533 | B2 | 4/2011 | LeMay et al. | |
| 7,946,911 | B2 | 5/2011 | Vang et al. | |
| 7,988,554 | B2 | 8/2011 | LeMay et al. | |
| 8,062,134 | B2 | 11/2011 | Kelly et al. | |
| 8,092,289 | B2 | 1/2012 | Mai | |
| 8,092,307 | B2 | 1/2012 | Kelly | |
| 8,092,309 | B2 | 1/2012 | Bickley | |
| 8,172,661 | B1 | 5/2012 | Hein | |
| 2002/0049909 | A1 | 4/2002 | Jackson et al. | |
| 2002/0175468 | A1 | 11/2002 | Kenny et al. | |
| 2004/0023712 | A1 | 2/2004 | Oliver | |
| 2004/0180722 | A1 | 9/2004 | Giobbi | |
| 2004/0204231 | A1 | 10/2004 | Martin et al. | |
| 2005/0032564 | A1 | 2/2005 | Sines | |
| 2005/0143166 | A1 | 6/2005 | Walker et al. | |
| 2005/0164762 | A1 | 7/2005 | Smith et al. | |
| 2005/0192092 | A1 | 9/2005 | Breckner et al. | |
| 2006/0040745 | A1 | 2/2006 | Wells et al. | |
| 2006/0058087 | A1 | 3/2006 | White et al. | |
| 2006/0068899 | A1 | 3/2006 | White et al. | |
| 2006/0189381 | A1 | 8/2006 | Daniel et al. | |
| 2006/0284376 | A1 * | 12/2006 | Snow | 273/292 |
| 2006/0287103 | A1 | 12/2006 | Crawford, III et al. | |
| 2007/0024005 | A1 | 2/2007 | Snow | |
| 2007/0026935 | A1 | 2/2007 | Wolf et al. | |
| 2007/0055753 | A1 | 3/2007 | Robb | |
| 2007/0072677 | A1 | 3/2007 | Lavoie et al. | |
| 2007/0111786 | A1 | 5/2007 | Snow | |
| 2007/0184905 | A1 | 8/2007 | Gatto et al. | |
| 2007/0197294 | A1 | 8/2007 | Gong | |
| 2007/0197298 | A1 | 8/2007 | Rowe | |
| 2007/0202941 | A1 | 8/2007 | Miltenberger et al. | |
| 2007/0213116 | A1 | 9/2007 | Crawford et al. | |
| 2007/0214058 | A1 | 9/2007 | Rouhi et al. | |
| 2007/0225061 | A1 | 9/2007 | Naobayashi | |
| 2008/0032763 | A1 | 2/2008 | Giobbi | |
| 2008/0039192 | A1 | 2/2008 | Laut | |
| 2008/0039208 | A1 | 2/2008 | Abrink et al. | |
| 2008/0073840 | A1 | 3/2008 | Comeau | |
| 2008/0096656 | A1 | 4/2008 | LeMay et al. | |
| 2008/0136102 | A1 | 6/2008 | Hoover | |
| 2008/0176627 | A1 | 7/2008 | Lardie | |
| 2008/0248875 | A1 | 10/2008 | Beatty | |
| 2008/0252011 | A1 | 10/2008 | Bickley et al. | |
| 2009/0100409 | A1 | 4/2009 | Toneguzzo | |
| 2009/0121434 | A1 | 5/2009 | Baerlocher et al. | |
| 2009/0124385 | A1 | 5/2009 | Cuddy | |
| 2009/0156310 | A1 | 6/2009 | Fargo | |
| 2009/0298577 | A1 | 12/2009 | Gagner et al. | |
| 2009/0302540 | A1 | 12/2009 | Snow et al. | |
| 2009/0315264 | A1 * | 12/2009 | Snow et al. | 273/292 |
| 2010/0016050 | A1 | 1/2010 | Snow et al. | |
| 2010/0048304 | A1 | 2/2010 | Boesen | |
| 2010/0069155 | A1 | 3/2010 | Schwartz et al. | |
| 2010/0178987 | A1 | 7/2010 | Pacey | |
| 2010/0197410 | A1 | 8/2010 | Leen et al. | |
| 2010/0234110 | A1 | 9/2010 | Clarkson | |
| 2010/0240440 | A1 | 9/2010 | Szrek et al. | |
| 2010/0255899 | A1 | 10/2010 | Paulsen | |
| 2011/0074107 | A1 | 3/2011 | Rowe | |
| 2011/0105208 | A1 | 5/2011 | Bickley | |
| 2011/0130190 | A1 | 6/2011 | Hamman et al. | |
| 2011/0159952 | A1 | 6/2011 | Kerr | |
| 2011/0159953 | A1 | 6/2011 | Kerr | |
| 2011/0165936 | A1 | 7/2011 | Kerr | |
| 2011/0172008 | A1 | 7/2011 | Alderucci | |
| 2011/0183748 | A1 | 7/2011 | Wilson et al. | |
| 2011/0230268 | A1 | 9/2011 | Williams | |
| 2011/0269529 | A1 | 11/2011 | Baerlocher | |
| 2011/0275430 | A1 | 11/2011 | Walker et al. | |
| 2011/0287829 | A1 | 11/2011 | Clarkson et al. | |
| 2012/0015724 | A1 | 1/2012 | Ocko et al. | |
| 2012/0015725 | A1 | 1/2012 | Ocko et al. | |
| 2012/0015743 | A1 | 1/2012 | Lam et al. | |
| 2012/0015747 | A1 | 1/2012 | Ocko et al. | |
| 2012/0021835 | A1 | 1/2012 | Keller et al. | |
| 2012/0034977 | A1 | 2/2012 | Kammler | |
| 2012/0295691 | A1 | 11/2012 | Walker | |
| 2013/0053117 | A1 | 2/2013 | Snow | |

FOREIGN PATENT DOCUMENTS

| | | | |
|---|---|---|---|
| WO | WO 2008/061001 | A2 | 5/2008 |
| WO | WO 2009/061618 | A1 | 5/2009 |
| WO | WO 2011/109454 | A1 | 9/2011 |

OTHER PUBLICATIONS

United States Office Action, U.S. Appl. No. 13/624,743, Jan. 29, 2013, 7 pages.

U.S. Appl. No. 13/860,991, filed Apr. 11, 2013, Inventors Andrew Costello et al.

U.S. Appl. No. 13/353,194, filed Jan. 18, 2012, Inventors Andrew Costello et al.

U.S. Appl. No. 13/609,031, filed Sep. 10, 2012, Inventors Andrew Costello et al.

U.S. Appl. No. 13/624,743, filed Sep. 21, 2012, Inventors Andrew Costello et al.

U.S. Appl. No. 13/864,069, filed Apr. 16, 2013, Inventors Louis J. Castle et al.

U.S. Appl. No. 13/871,824, filed Apr. 26, 2013, Inventors Louis J. Castle et al.

International Search Report of the International Searching Authority for PCT/US13/22153, dated Apr. 8, 2013, 2 pages.

(56) References Cited

OTHER PUBLICATIONS

International Search Report and Written Opinion of the International Searching Authority for PCT/US13/21959, dated May 10, 2013, 7 pages.

International Search Report of the International Searching Authority for PCT/US2013/038688, dated Oct. 10, 2013, 4 pages.

United States Office Action, U.S. Appl. No. 13/631,821, Oct. 29, 2013, 7 pages.

United States Office Action, U.S. Appl. No. 13/631,818, Oct. 29, 2013, 8 pages.

* cited by examiner

FOUR-CARD POKER GAME WITH VARIABLE WAGER

CROSS-REFERENCE TO RELATED APPLICATIONS

This application is a continuation-in-part of U.S. patent application Ser. No. 13/631,818, filed Sep. 28, 2012, pending, which is a continuation-in-part of U.S. patent application Ser. No. 11/499,864, filed Aug. 4, 2006, pending, which is a continuation of U.S. patent application Ser. No. 10/152,325, filed May 20, 2002, now abandoned, the disclosure of each of which is hereby incorporated herein, in its entirety, by this reference.

TECHNICAL FIELD

The present invention generally relates to a card game that can be played in a casino or in a card room. More particularly, it relates to a modified version of a stud poker game.

BACKGROUND

Many different wagering games presently exist for use in both home and casino environments. Such games should necessarily be exciting, uncomplicated, and easy to learn to avoid frustrating players. Designing new games that meet these criteria and are sufficiently different from old games to entice players to play the new games is a particular challenge.

BRIEF SUMMARY

A casino table poker game is played with poker hands of players competing against a poker hand of a dealer. A player enters the game by placing one or both of a bonus wager (also referred to as an "Aces Up" wager) for competition against a pay table and an ante wager for direct competition against the dealer. The player is dealt more cards than needed to form a poker hand. The dealer is also provided with more than the required number of cards, from which a number of cards is selected for the dealer hand to play. The player is provided with bonus payouts (e.g., multiple returns) on the Aces Up wager for ranked hands or a pair of aces or better. The player hands also compete directly against the rank of the dealer hand if an additional play wager is placed to supplement the ante wager. The additional play wager may be varied by the player to be 1×, 2×, 3×, 4×, or 5× the amount of the ante wager. Bonuses may also be paid on the Aces Up wager or the ante wager with unusually high-ranking player hands (such as a straight flush or a four-of-a-kind), whether or not the rank of the player hand exceeds the rank of the dealer hand.

Further embodiments may include one, some, or all of the following: The acts of the dealer may be carried out by a visual representation of a dealer, the visual representation being generated and/or displayed by a computer. The visual representation may be a virtual person (e.g., an animation) or may be a transmission (e.g., a video) of an actual person. The transmission may be in the form of a video transmission that provides live video feed, or the transmission may be prerecorded. The visual representation may be part of an online gaming experience of the disclosed game, or it may be part of a gaming device. The acts described in this disclosure as being associated with a dealer, including dealing cards, displaying or turning over cards, arranging cards to form player and/or dealer hands, accepting game play election options from a player, receiving or paying wagers, or any other actions, may be represented in any way when used in an online environment. For example, the cards associated with a dealer action, described as being dealt or otherwise handled by a dealer, may appear as virtual cards or as transmitted pictures of physical cards. This may include a display of virtual card decks, wherein each deck, individual card, and hand is displayed to an online player in a manner consistent with the game play disclosed herein, but may or may not include a visual representation of a dealer with the cards. Likewise, betting activity may be displayed in any manner to a player, including, but not limited to, virtual chips, betting pools, numbers, meters, account balances, or other indicia of a wager amount.

The online experience may involve players playing remotely (e.g., in a different physical location) from the dealer, from the location of a game server, or from both, interacting through a networked connection that may include, but is not limited to, the Internet. The online game play may involve players who are also physically remote from each other. Remote connections may use networks involving several types of network links, including, but not limited to, the Internet. Networked connections allowing physically remote players to play a game using a game server or system may be part of an implementation of a virtual or online gaming environment.

The actions described in this disclosure as the acts of a player, including betting, card selecting (if any), card discarding (if any), or any other actions, may be carried out over a network, wherein the indicated actions are received as input to a user device. The input-receiving user device is typically physically remote from the game server or game host and is connected over a long-distance network, but it may also be implemented over a wired or wireless LAN in one building, or even in one room, for example. In one embodiment, game play generated at the server or host location may be displayed on the same device as the receiving device. In some embodiments, game play may be conveyed to remote players in devices separate from the devices receiving input from a player. For example, the game play may be conveyed to remote players by public screens or publicly broadcast data about a game coupled with individual or private input devices. The reception of an input at a user device may be accomplished through any technology adapted for such a purpose, including, but not limited to, keypads, keyboards, touchpads, mice, optical location devices, eye movement/location detectors, joysticks, toggle switches, motion detection devices, sound input devices, etc. When discussing a device, such as a user device, it is understood the device may comprise multiple components and be complex, including hardware components combined with firmware and/or software, and may itself be a subcomponent of a larger system.

Yet other embodiments may comprise apparatuses and systems for administering wagering games according to embodiments of the disclosure.

BRIEF DESCRIPTION OF THE DRAWINGS

While the disclosure concludes with claims particularly pointing out and distinctly claiming embodiments within the scope of the disclosure, various features and advantages of embodiments encompassed by the disclosure may be more readily ascertained from the following description when read in conjunction with the accompanying drawings, in which:

DETAILED DESCRIPTION

The illustrations presented herein are not meant to be actual views of any particular act in a method of administering a wagering game, apparatus for use in administering a wagering game, or component thereof, but are merely idealized representations employed to describe illustrative embodiments. Thus, the drawings are not necessarily to scale. Additionally, elements common between figures may retain the same or similar numerical designation. Elements with the same number, but including a different alphabet character as a suffix, should be considered as multiple instantiations of substantially similar elements and may be referred to generically without an alphabet character suffix. For example, elements 100*a*, 100*b*, and 100*c* may be a device that is instantiated three times and referred to generically as element 100.

The terms "gaming," "gambling," or the like, refer to activities, games, sessions, rounds, hands, rolls, operations, and other events related to wagering games, such as web-based games, casino games, card games, dice games, and other games, the outcome of which is at least partially based on one or more random events (i.e., "games of chance") and on which wagers may be placed by a player. In addition, the words "wager," "bet," "bid," or the like refer to any type of wagers, bets, or gaming ventures that are placed on random events, whether of monetary or non-monetary value. Points, credits, and other items of value may be purchased, earned, or otherwise issued prior to beginning the wagering game. In some embodiments, purchased points, credits, or other items of value may have an exchange rate that is not one-to-one to the currency used by the user. For example, a wager may include money, points, credits, symbols, or other items that may have some value related to a wagering game. Wagers may be placed in wagering games that are "play for pay" as well as "play for fun," as will be described in more detail below.

Figure 1:
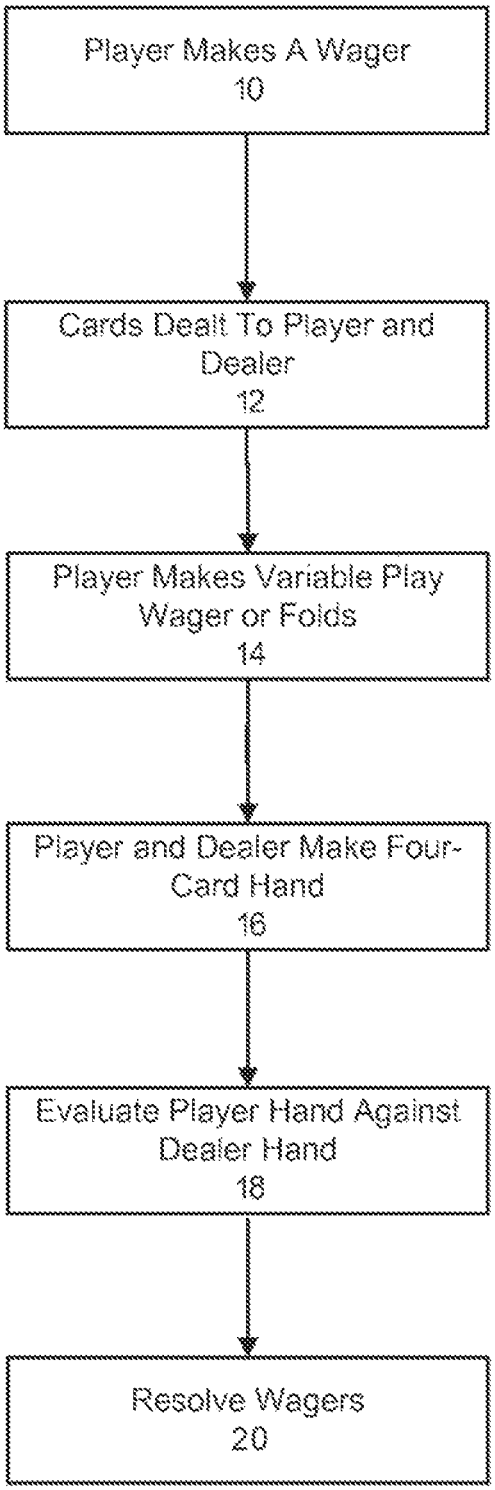
FIG. 1 is a flowchart diagram of a method of administering a wagering game.

Referring to FIG. 1, shown is a flowchart diagram of a method of administering a wagering game. A card game is played by at least one player and a dealer. For simplicity in the following discussion, a single player's actions are described, though multiple players may play simultaneously. In some game formats, such as a live casino table game, between five and seven player positions are present to participate in a same game. The dealer usually represents the house or the casino in the play of the game. In this embodiment, a player may make at least one wager to participate in play of the game (operation 10). The player may make an ante wager against a dealer hand, a bonus wager such as an "Aces Up" wager against a pay table, or both an ante wager and a bonus wager at the beginning of each round. At the same time, the player may elect to participate in other optional side wagers, such as a bad-beat side wager, a progressive side wager, or both optional side wagers.

To initiate play of the game, at least one (and usually only one) deck of standard or variant playing cards is provided. Typically, a single 52-card deck of standard playing cards, including an ace, a two, a three, a four, a five, a six, a seven, an eight, a nine, a ten, a jack, a queen, and a king of each of hearts, diamonds, clubs, and spades suits are utilized. A standard deck may also include one or two jokers. In other forms of the game, multiple intermixed decks of cards, decks with wild cards, or special decks (i.e., decks with certain cards removed) are used. After placing the at least one wager indicating participation in the game, a hand of cards is dealt (operation 12) to each of the player and the dealer. Players may be permitted to continue making wagers as long as no card faces are exposed, at the discretion of the operator of the game.

In one embodiment, the dealer is dealt six cards, with one card dealt face-up, while the player is dealt five cards, each card face-down. In other embodiments, the number of cards dealt to the player is equal to the number of cards dealt to the dealer, and, in general, at least one card, in addition to the number of cards required to form a complete hand, is dealt to the player and to the dealer. In other examples of the invention, one, multiple, or no dealer cards may be exposed at the time the cards are dealt. In this embodiment, the player and the dealer form four-card poker hands.

After receiving the cards, and before or after the player examines the player cards and the dealer's exposed card, the dealer receives a game play election from the player, and the player determines whether to make a variable play wager or to fold the hand (operation 14). When the dealer receives a play wager from the player without the player viewing the cards, the player is said to play the hand "blind." The amount of the variable play wager, available for the player to make, varies based on the rules of the particular game. In one embodiment, the player may wager 1× to 3× the player's ante wager as a play wager. In other embodiments, the player can make a 1× to 5× play wager. Alternatively, the player may elect to fold. When a fold election is received by the dealer, the player's ante wager is forfeited. Next, the player and the dealer each make a four-card hand based on the cards dealt to each (operation 16). That is, the player discards a card from the player's five cards, while the dealer discards two cards from the dealer's six cards. The act of discarding may include returning the card or cards to the dealer, or may include moving active cards towards the dealer, and not moving the discards. The act of discarding may also comprise turning those cards face-down on the table.

The player's four-card hand is evaluated against the dealer's four-card hand (operation 18) using a four-card poker ranking to determine whether the player hand beats the dealer hand. In computer-controlled embodiments, the processor may determine a best four-card hand based on pre-established criteria. In other embodiments, the dealer hand is set the "house way," i.e., using the pre-established criteria, and the processor receives inputs from a user device indicating which cards to use in the hand. Based on the evaluation, the wagers are resolved (operation 20). When the player has made an ante wager and a play wager against a dealer hand and the player hand beats or ties the dealer hand, the player wins the ante wager and the play wager. In examples of the invention, the ante wager and the play wager pay 1:1. When the player hand does not beat or tie the dealer hand, the player loses the ante wager and the play wager.

In one example of the invention, if the player and dealer hands tie, the ante wager and the play wager are resolved in favor of the player. In other examples, ties push. In yet other examples, tie hands lose to a dealer hand. Additional variants and embodiments of four-card wagering games are described below. While generally describing four-card wagering games, these methods of play are not limited to four-card hands and are more generally applicable to more or fewer cards forming a hand. These wagering games may include more or fewer cards dealt to a player and with additional or fewer wagers placed by the player, such as a bonus wager and a "super bonus" wager, as further described below.

Figure 2:
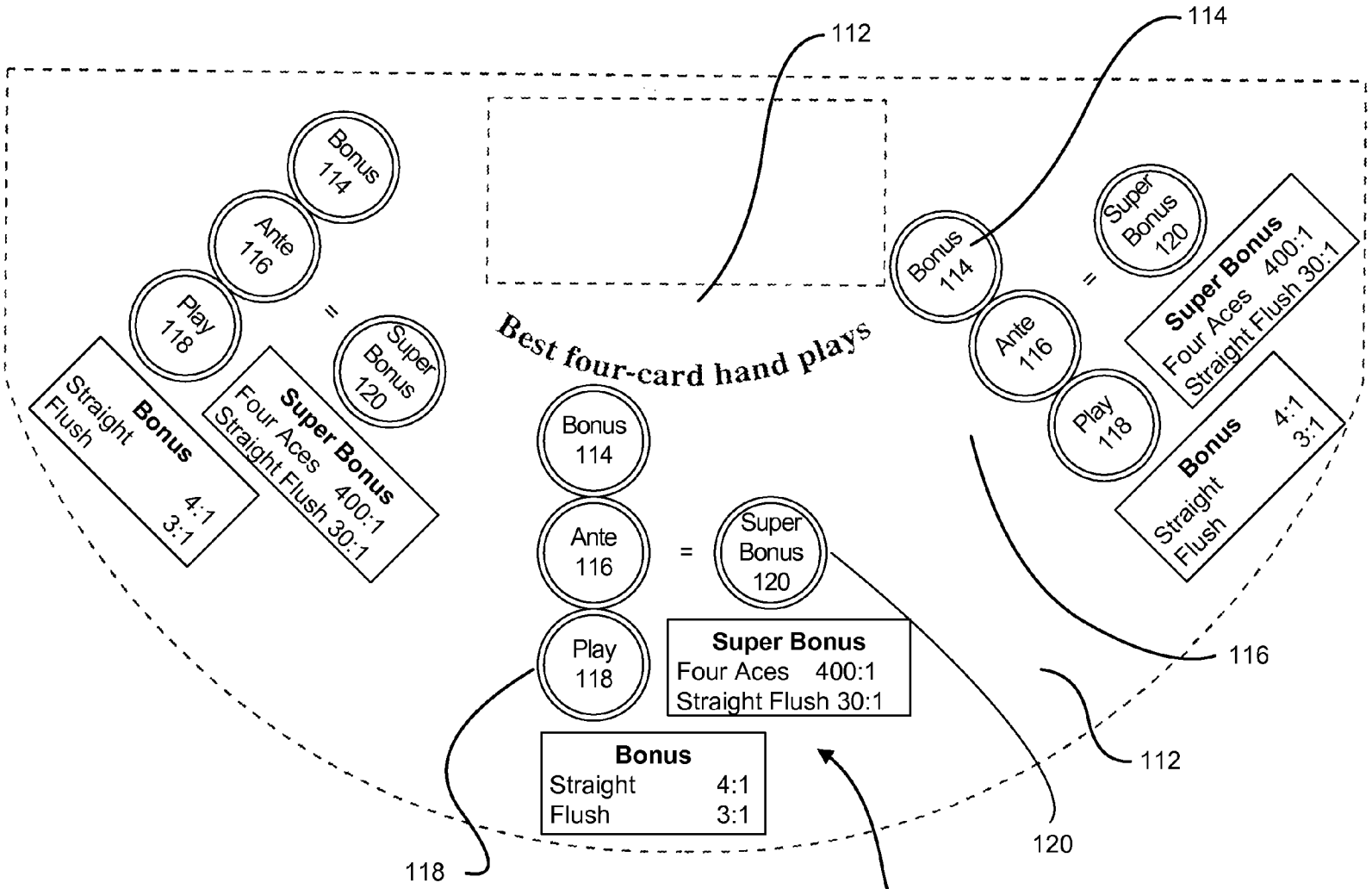
FIG. 2 is a diagram of a playing surface for implementation of the wagering game.

Referring to FIG. 2, shown is a diagram of a playing surface for implementation of exemplary wagering games within the scope of the present disclosure. A player position 110 is provided for each player, and card-receiving areas 112 are available for each of the players and the dealer. The player position 110 may include three distinct wagering zones, including a bonus wager area 114 (also termed an "Aces Up" wager area), an ante wager area 116, and a play wager area 118. The player position 110 may also include a super bonus wager area 120. In some examples of games of the present disclosure, no super bonus wager option is available for play. Other possible wager areas that are not shown that are contemplated by the present invention include a betting circle for an optional side wager on a two-way bad beat and an electronic betting sensor for receiving an indication of a wager indicating participation in an optional side wager on a progressive jackpot. Each player who wishes to enter the play of the game makes at least one wager selected from the bonus wager (or Aces Up wager) and the ante wager. One or both of these wagers may be made. The player may also play the hand blind (also referred to as the "house way") by placing both an ante wager and an additional play wager (also referred to as the "game wager") on betting circles 116 and 118 (i.e., the ante wager area 116 and the play wager area 118) before viewing the cards.

Figure 3:
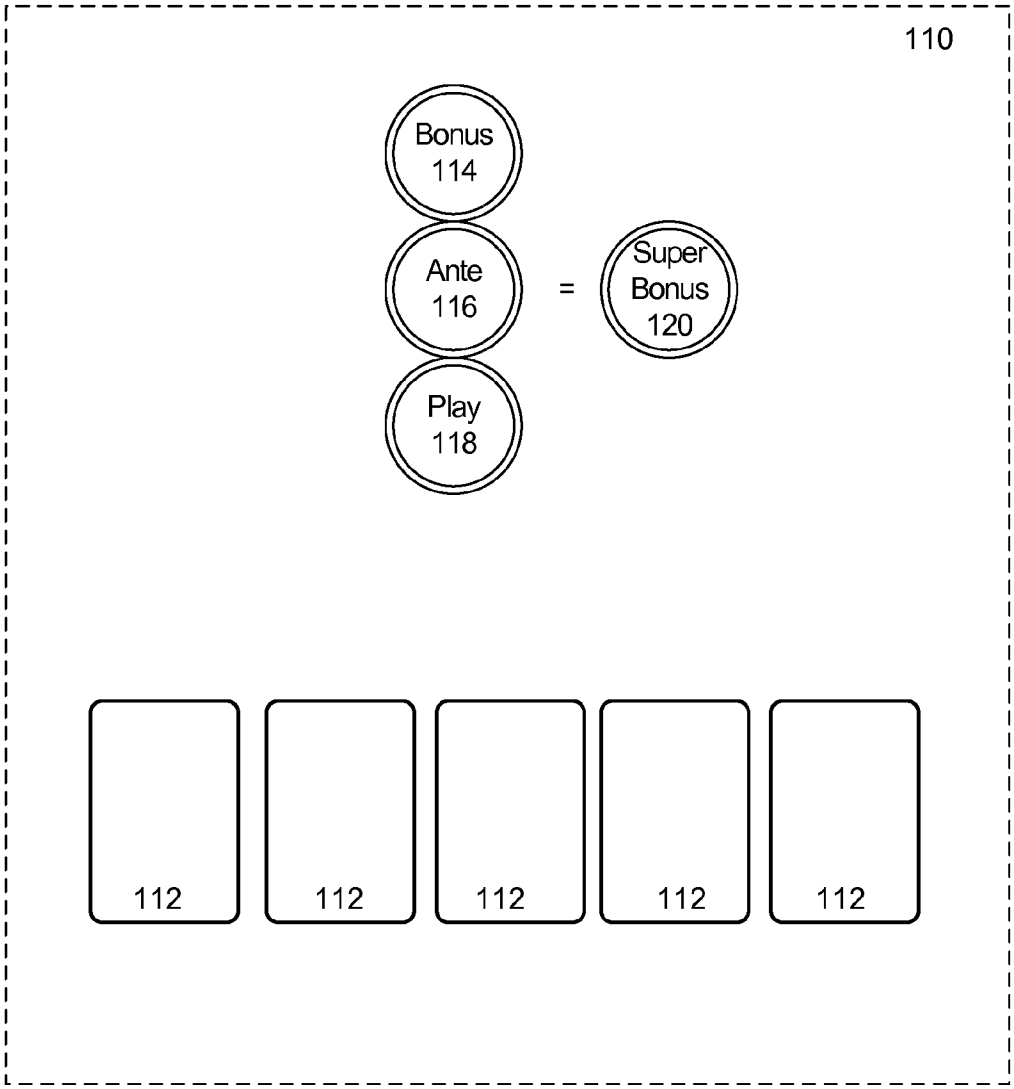
FIG. 3 is an enlarged diagram of one of the player positions of the playing surface of FIG. 2.

Referring to FIG. 3, shown is an enlarged diagram of one of the player positions 110 of the playing surface of FIG. 2. In one embodiment of the player position 110, the card-receiving areas 112 include an area for each card received by a player, in this case five cards. In other embodiments, the card-receiving areas 112 are not marked or are marked with multiple cards together in one location. Also shown in this embodiment is the super bonus wager area 120 for a wager termed a "super bonus" wager. This super bonus wager may be used in certain embodiments of the described wagering game and may not be used in other embodiments. When the super bonus wager is used, the wager is generally required to be equal in amount to the ante wager (at the ante wager area 116), as indicated by the equal sign between the ante wager area 116 and the super bonus wager area 120. When the super bonus wager is not part of the embodiment being used, the super bonus wager area 120 may be omitted from the player position 110. Though not shown in FIG. 3, a pay table may also be provided at each player position 110, on written materials available to the player, or on signage, when the game is played at a table, and may be accessible on a display when the game is played electronically.

After placement of the at least one wager, each player who has made at least one wager is provided with five cards, in this embodiment, from which to select a best four-card poker hand. The cards may be dealt as a complete set of five cards or in portions of one or more cards. At about the same time, the dealer is dealt a number of cards exceeding four. In one embodiment, six cards are dealt to the dealer. One or more additional cards can be dealt to the player, to the dealer, or to both.

Although, in one example, the dealer receives one more card than each player, the number of cards dealt can be equal. In particular, enough cards are dealt so that at least one discard can be made.

In an embodiment, a four-card poker hand is played. The player reviews the five cards received at his or her player position 110 and determines what best four-card poker hand can be made from the five cards. In alternative embodiments, a processor or the dealer may determine which cards make the best four-card hand from the available player cards. If the player believes that the cards cannot form a four-card poker rank of sufficiently high rank to warrant competition against the dealer hand (even without that hand or any portion of that hand having been displayed), the dealer may receive a player election to fold the hand. The house would not receive a play wager if the player refused to place an additional play wager to stay in the game. At this time, or usually at a later time, the ante wager would be collected by the dealer.

In one example, if the player made the Aces Up wager and the ante wager and decides to fold, the Aces Up wager is swept along with the ante wager. In another embodiment, the Aces Up wager remains in play regardless of whether the dealer receives a player election to fold. In some embodiments, if the player initially made an ante wager and an Aces Up wager, the player elects to remain in the game by making the play wager, and the player hand does not contain a hand ranking of a pair of aces or higher, that wager may be now or later collected by the dealer.

If the player determines that the rank of the best four-card poker hand that can be made from the five cards dealt to the player is sufficiently high as to warrant competition against the dealer (or if the player wants to "bluff" against the dealer, particularly if the dealer must qualify), the player makes an additional wager, referred to as a "play wager" or a "game wager." That additional wager may be a multiple of the ante wager, such as 1×, 2×, 3×, 4×, or 5× the amount of the original ante wager, at the option of the player. In some embodiments, the game wager is 1× the ante wager unless the player has a qualifying hand, such as a pair of kings or better, for example. If the player hand qualifies, the player has the option of increasing his or her wager. Fractional amounts or larger amounts may be allowed, but they can complicate the payout or alter the hold for the house; so, those changes are in the discretion of the casino. After placing the game wager and discarding excess cards, placing the fifth card face down, or merely leaving the fifth card in the hand so that the hand may be arranged and ranked by the dealer or player when exposed, the player hand is placed on the table for display. The dealer hand is then revealed after each and every player has determined whether or not the game wager (play wager) is to be made. The dealer compares the value or rank of his or her hand against the value or rank of each player hand, usually in succession around the table, and each series of wagers (the Aces Up wager, the ante wager, and the game wager) is resolved. Ties on the rank of the player hand and the dealer hand may either be paid to the player, returned to the player (called a "push"), or collected by the dealer, depending upon the desired house advantage the casino wants to build into the game. The dealer may either always qualify to play or a level of qualification may be built into the game (such as at least a queen high, at least a king high, at least a queen-jack, at least a king-jack, at least an ace-king, or at least one pair). In one embodiment, there is no dealer qualification requirement.

Resolution on the wagers may be based upon pay tables for the Aces Up wager, pay tables on the ante wager, and/or the game wager (play wager). One embodiment of play of the game provides pay tables for one or more of the Aces Up wager, the ante wager, and an automatic bonus payout on the ante wager. In one example, the ante wager and the game wager (play wager) pay one-to-one with a player win. Because the player can see the strength of the player hand and, in some embodiments, with partial information on the dealer hand when making the game wager (play wager), the player would be at an extreme advantage in placing a 5× game wager, when the player holds a very strong hand, assuring a very high multiple payout, with essentially no risk or little risk involved in the placement of the 5× game wager. The payout of wagers may be tailored by the casino by selecting pay tables designed for greater player payouts or greater casino earnings.

Although a four-card poker game is one embodiment, the game could also be played with three, five, or seven cards, with necessary adjustments to the pay tables.

For example, in a four-card game, the hierarchy of hands is as follows:

Four-of-a-Kind
Straight Flush
Three-of-a-Kind
Flush
Straight
Two Pair
Pair
High Card.

A three- or five-card game may require a different hierarchy of hand rankings.

There are many variations of the game that may be played. The following variations on the format described above illustrate the expanded scope of play available under various methods.

Version I

Each player receives five cards, and the dealer receives six cards. The players and the dealer each identify his or her best four-card poker hand. The players may rely upon the house for assistance, if needed. The dealer always qualifies. That is, the dealer hand and any player hand are always in play if the ante wager is made. Players have the choice of placing one or both of the ante wager and a bonus wager (e.g., the Aces Up wager). House rules may require the player to make the ante wager, the bonus wager, or both the ante wager and the bonus wager. The ante wager is a wager directly against the rank of the dealer hand, and the Aces Up bonus wager is a wager against a pay table. If, after viewing his or her hand, a player chooses to stay in the game against the dealer (keeping the ante wager in play), the player must make an additional game wager to stay in the game. This game wager may be, for example, between 1× and 5× (or between 1× and 4×, or between 1× and 3×) the amount of the initial ante wager at the opinion of the player. In other forms of the game, the player's game wager must be 1× the ante wager unless the player holds a qualifying hand of a pair of aces or better. In some embodiments, if the player has a qualifying hand, he or she can bet up to 3× the ante wager. The player must hold a pair of aces or better to win on the bonus wager (hence the name "Aces Up") in this embodiment. The bonus wager pays a maximum return of 50:1, in one embodiment, but payouts may theoretically be as high as 500:1 for certain hands, such as for four aces. The bonus wager side wager game may or may not be present in the rules of the game. In this example, the game pays an automatic bonus for certain high-ranking hands according to a payout schedule. This bonus is paid on the ante wager and does not require the player to make a separate wager to qualify for this payout. An "automatic bonus" is an additional payout that can be made to a player for a game outcome without requiring receipt of a wager to participate in the specific bonus event. For example, in an embodiment where a player places an ante wager, the wager will pay a first payout if the player hand ties or outranks the dealer hand and a second automatic bonus for a hand of a predetermined winning composition. For example, automatic bonuses are paid on four-card hand compositions of a three-of-a-kind, a straight flush, and a four-of-a-kind.

Version II

Each player and the dealer get five cards to make the best four-card poker hand. If the dealer hand does not equal or exceed a certain rank (e.g., a pair of twos or better), he or she discards all cards, draws a new five-card hand, and makes a four-card poker hand from the five cards. The player must make the ante wager to be in the game against the dealer. The dealer always qualifies to play against the player. It is possible to allow the player, or require the player, to make the ante wager 1) before the deal of cards, 2) after the deal of cards but before any cards are revealed, 3) after the deal of cards and after the player has reviewed his or her cards but before the dealer has exposed cards, 4) after the deal of cards and a partial or complete revelation of the dealer's five cards (but before review of the player's cards), or 5) after the deal of cards and a review of the player's cards and a partial revelation or a complete revelation of the dealer's five cards, which play might be restricted to when the dealer has not qualified (but not after revelation of any sixth card). The player hand may be required to exceed a minimum rank to bet more than 1× the ante wager. For example, if the player has a qualifying hand of a pair of kings or better, the player can make a game wager of 1×, 2×, or 3× the ante wager. As with Version I, the rules can provide that the bonus wager (side wager) is mandatory or that both initial wagers (the ante wager and the bonus wager) are mandatory. The automatic bonus against a pay table on the ante wager may or may not be present in the rules of the game. The bonus wager game may or may not be present, also, in the rules of the game. In this example, a pair of aces or better qualifies the player for an Aces Up payout of 1:1. The automatic bonus pays even if the player hand is lower in rank than the dealer hand.

Version III

The players and the dealer each receive five cards to make his or her best four-card poker hand. The betting/wagering rules and procedures are the same as in the previous versions, except for those listed below. Either the ante wager is mandatory, the ante wager or the bonus wager is mandatory, or both initial wagers are mandatory. The dealer must qualify to play (for example, with a hand of ace high or higher, king-queen or higher, ace-king or higher, a pair of twos or higher, etc.). The automatic bonus against a pay table is present in the rules of this example of the game.

If the player stays in the game, the player can bet 1× to 3× the ante wager if the player has a qualifying hand of a pair of kings or better. Otherwise, the maximum game wager is 1× the ante wager. The lowest ranking hand that qualifies for the bonus payout is a pair of aces or better.

Version IV

Four-Card Poker with Super Bonus

The dealer and each player are dealt five cards each. The cards are used to make the best four-card poker hand by the players and the dealer. The hands are ranked according to the following four-card poker ranking schedule:

Four-of-a-Kind
Straight Flush
Three-of-a-Kind

Flush
Straight
Two Pair
Pair
High Card.

Players can make a bet against the dealer (ante wager), a bet against the pay table (Aces Up bonus wager) or both. House rules may require one or both wagers to be mandatory. In addition, the players are required to make a super bonus wager in an amount equal to the ante wager, in this version.

Players place equal wagers on the ante wager area 116 and/or the super bonus wager area 120 and/or the bonus wager area 114 on the layout. After viewing the cards, the player must fold or place an additional wager (play wager). If the player hand does not qualify with a pair of kings or better, the player must bet 1× the ante wager to stay in the game. With a qualifying hand of a pair of kings or better, the player can bet an amount equal to or multiples of the ante wager, such as 1×, 2×, or 3× the ante wager.

If the player has a higher-ranking hand than the dealer hand, the player is paid 1:1 on the ante wager and the play wager. If the dealer hand outranks the player hand, the player loses the ante wager and the play wager.

The player has the option (or may be required), at the beginning of the game, to place an Aces Up bonus wager. In this example, the player wins a bonus payout for a pair of aces or better. If the player makes the ante wager and the play wager and beats the dealer, but does not have a pair of aces or better, the player pushes on the bonus wager. The player is always paid on the Aces Up bonus wager, regardless of whether or not the player hand beats the dealer hand.

In addition, this example includes a mandatory super bonus wager that is made in an amount equal to the ante wager. The player wins a payout for certain high-ranking hands, such as a straight flush or a four-of-a-kind A pay table is provided on the layout to identify winning hands and payout amounts.

A failure to obtain a "super bonus" hand does not result in an automatic loss of the wager. For example, when the player hand against the dealer does not qualify with a pair of kings or a straight flush or better, but the hand still beats the dealer, the super bonus wager pushes. But, if the player folds on the ante wager or loses the ante wager and the play wager against the dealer, the super bonus wager is also lost.

The super bonus wager is desirable in some instances where it is desired to provide the house with more of an advantage. In this example of the game, removing the mandatory super bonus wager causes the game to favor the player. However, other rule changes, such as requiring the dealer to qualify or raising the minimum qualification hand ranking when making the play wager, are other means to shift the odds to favor the house.

There are a number of advantages of the games as described herein. The fold rate for a player using good strategy on this game is approximately 21%, which is lower than the fold rate in some other games. This feature is believed to attract and retain players, making the game more appealing to casinos.

Players win this game approximately 48% of the time, which exceeds the expectation of many players and increases player appeal.

In some situations, e.g., when the player has a qualifying hand, additional betting opportunities are available, such as tripling down on the ante wager, increasing player appeal.

By varying the number of cards made available to the dealer and/or players in forming the hands, by requiring the dealer hand to qualify, by eliminating dealer qualification, by modifying the payouts and winning hand combinations possible on the bonus wager, by adding the super bonus wager, etc., the payouts can be made to pay as high as 500:1, e.g., for a four-of-a-kind hand. This feature is believed to attract and retain more poker players.

Various platforms are contemplated that are suitable for implementation of embodiments of wagering games according to the present disclosure. For example, embodiments of wagering games may be implemented such that one or more players may place wagers and engage in game play according to the rules of the wagering games. For example, wagering games may be implemented as "felt games," that is, games administered on gaming tables, which may include physical gaming features, such as physical cards, physical chips, and may include a live dealer and a shuffler or shoe. More specifically, a live dealer may deal physical cards, accept wagers, issue payouts, and perform other administrative functions of game play. Some embodiments may be implemented on electronic devices enabling electronic gaming features, such as providing electronic displays for display of virtual cards, virtual chips, game instructions, pay tables, etc. Some embodiments may include features that are a combination of physical and electronic features.

As an example, embodiments of wagering games may be implemented on a user device for inputting commands that are received by a processor. The processor receives the instructions, indicating acceptance of a wager or wagers. The user device may have a display screen and input devices for enabling interaction with the processor. Such an individual user device may be remote from the processor. Some user devices may be gaming devices, such electronic gaming machines. Other user devices may be non-gaming devices, such as conventional personal computers, tablets, cell phones, or other devices with networking capability. Electronic game machines may also be referred to as individual player "cabinets" or "terminals" and may be stationary, such as being located on a casino floor. Other user devices may be portable devices that may be carried to different locations by the player. A portable device may include both display of the ongoing game play and input reception for game play by a player, and it may be configured for receiving input from a player while the game play is displayed on a public monitor or other display device. Game play and game outcomes may also be displayed on a portable user device.

As previously noted, the present games and rules may be played as live casino table card games, as hybrid casino table card games (with virtual cards or virtual chips), on a multiplayer electronic platform (as disclosed in U.S. patent application Ser. No. 10/764,827 (published as U.S. Patent Application Publication No. 2005/0164759 A1 on Jul. 28, 2005) (now abandoned); Ser. No. 10/764,994 (now U.S. Pat. No. 7,661,676, issued Feb. 16, 2010); and Ser. No. 10/764,995 (now U.S. Pat. No. 8,272,958, issued Sep. 25, 2012), all filed on Jan. 26, 2004, the disclosure of each of which applications is hereby incorporated herein in its entirety by this reference), on a personal computer for practice, on a hand-held game for practice, or on a user device interacting with a legally authorized online casino site on the Internet.

In one embodiment, the players are remotely located from a live dealer, and the players observe a live dealer and a game table on their monitors via a video feed. In some embodiments, the players' user devices may include a camera, and player video feeds may be transmitted to the dealer and may be shared among the players at the table. In a sample embodiment, a central station includes a plurality of betting-type game devices, such as a studio with multiple gaming tables, and an electronic camera for each game device. A plurality of player stations are provided on each gaming table. The table may include one or more monitors, viewable by a live dealer, for displaying a remote player's game play election. The players are physically remote from the central station and may input a selection, which is received by the central station, to select a particular game device, such as a particular three-card poker game table, and a particular player station that is open at the table. A processor associated with the central station receives the game device and table position election inputted remotely at the user device.

Remote players may utilize the input device to place a wager or wagers or to make game play elections relating to an action involving an element of chance to occur at the selected game device. Signals indicating the user inputs are received by a server located remotely from the players. The server is in communication with the game devices. Players may also be located remotely from one another.

Further details on gambling systems and methods for remotely located players are disclosed in U.S. Pat. No. 6,755,741 B1, issued Jun. 29, 2004, titled "Gambling Game System and Method for Remotely-Located Players," the disclosure of which is incorporated herein in its entirety by this reference, and in connection with FIGS. 9 and 10.

In some embodiments, the wagering games described herein may be played against the house (i.e., be "house-banked"), which may involve playing against a dealer hand or a pay table, with payouts on wagers being paid by a casino or other gaming establishment and losses on wagers being collected by the casino or other gaming establishment. For example, payouts associated with the ante wager, play wager, bonus wager, and (if applicable) super bonus wager may be banked by the house and payouts made by the house. In the house-banked game, the player hand is played against the dealer hand, wherein the player's four-card hand is compared against the dealer's four-card hand. When the player makes an ante wager and makes a play wager, these wagers may be resolved against an account of the house, such as a dealer adding player chips to a chip rack of the house or adding chips to the player stacks from the chip rack of the house.

Figure 4:
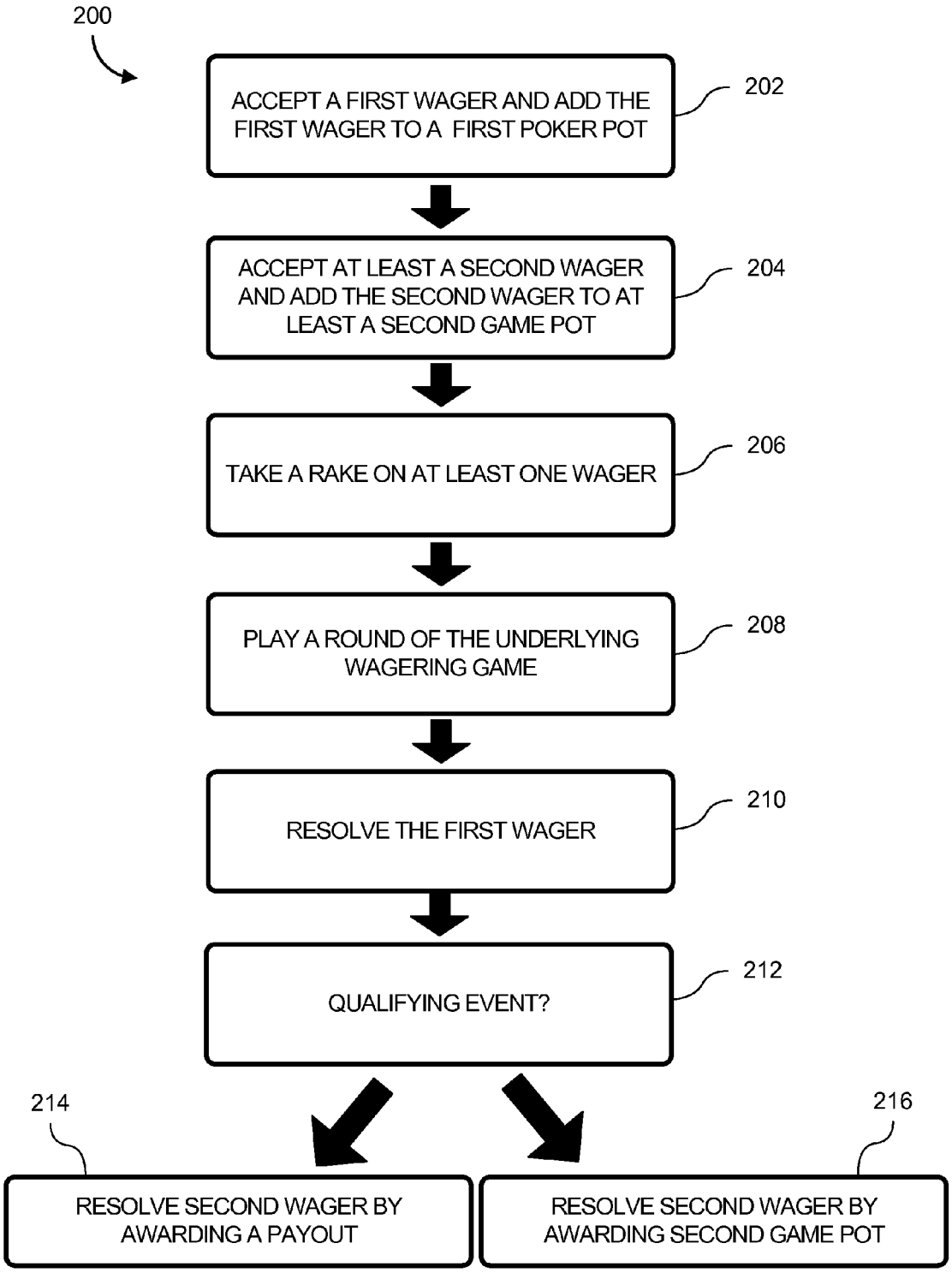
FIG. 4 is a flowchart diagram of a method of administering a wagering game that may be at least partially player-pooled.

In other embodiments, the wagering games, or at least one wager associated with the wagering game, may enable players to play against one another (i.e., be "player-pooled"), with payouts on wagers being paid from a pot and losses on wagers being collected by other players. Referring to FIG. 4, shown is a flowchart diagram of a method 200 of administering a player-pooled wagering game.

In other embodiments, the wagering games, or at least one wager associated with the wagering game, may enable players to play against one another (i.e., be "player-banked" or "player-pooled"), with payouts on wagers being paid from a pot and losses on wagers being collected by other players. Player-banked games allow a player or a professional banker to take all other player losses and pay payouts to players. In a player-banked version of a game of the present disclosure, a house may provide a dealer to administer the game and may rake wagers made, rake payouts won, or charge a flat fee for playing the game. Player-banked games are typically offered as live table games in card rooms where house-banking gaming is not permitted by local gaming regulations. Player-pooled variants of games may be offered as live table games, but they are more typically offered in an electronic format, wherein tracking the value of a jackpot pool is conducted using computer-controlled equipment. Player-pooled variants are particularly useful when regulators of online casino play permit the play of "poker."

Referring to FIG. 4, shown is a flowchart diagram of the method 200 of administering a wagering game, which may be at least partially player-pooled. The method 200 includes accepting a first "poker" wager from a player and adding the first poker wager to a first poker pot (e.g., a pool or accumulation of bets), as indicated at operation 202. The wagers contributed to the poker pool may be raked, in one example of the invention.

A second wager may be received at operation 204. The second wager may comprise, for example, a base game wager (e.g., ante wagers, blind wagers, play wagers, raises, and other wagers made on the underlying wagering game) or a side wager. Second wagers may be raked. Alternatively, payouts on second wagers may be raked. More specifically, the second wager may comprise, for example, the ante wager and any of the play wagers, or a separate pay table or progressive side wager. The second wager may be accepted, for example, by performing any of the acts described previously in connection with FIG. 1. In one example, the second wager may comprise all wagers made in a four-card game as described above, and the first wager may be an additional "poker" wager. The first poker pot may be non-progressive, meaning that the entire value of the pot is distributed to a player at the conclusion of a round of play. If two players tie with a highest-raking hand, the poker pot may be split. In other embodiments, the player holding the highest-ranking hand is awarded a percentage of the pot, and a player holding a second highest-ranking hand is also awarded a percentage of the pot. An exemplary split between highest and next highest hand is 80/20, for example.

The second pot may be separate from the first pot. For example, the first and second pots may include chips located in separate areas on a gaming table when the wagering game is conducted live in a casino. As another example, the first and second pots may be displayed as separate amounts on one or more video displays (gaming screen 374 (FIG. 5), playing surface 404 (FIG. 6), player interface 416 (FIG. 6), dealer interface 418 (FIG. 6), upright display 430 (FIG. 6), player interface area 532 (FIG. 7), dealer screen 560 (FIG. 7), card screen 564 (FIG. 7), and display 758 (FIG. 10)) (e.g., a monitor) controlled by one or more processors (control processor 350 (FIG. 5), local game processor 414 (FIG. 6), central game processor 428 (FIG. 6), central processor 597 (FIG. 7), and processor 742 (FIG. 10)) and may be maintained in separate accounts when the wagering game is conducted online. The second wager may enable a player to be eligible to win an additional award, such as, for example, a progressive payout for a predetermined premium hand.

In one embodiment, all odds payouts are paid out of the second pot, and all losses are accumulated in the second pot. When a predetermined event occurs, such as a player holding a predetermined premium hand, such as a royal flush in hearts, for example, the administrator of the game may, at operation 214, award the entire second pot to the player holding the premium hand.

In other embodiments, all normal game wagers, such as the ante wager and all play wagers in the present game, are placed in the second pot, and all payouts are made from the second pot. Excess amounts that grow in the pot are redistributed to players in the form of a dividend distribution (e.g., a share of the second pot awarded to each participating player) from the second pot. The second wager may comprise, for example, the ante wager or any of the play wagers.

In some embodiments, the second wager may be a mandatory wager. In other embodiments, the second wager may be optional, and a player wishing to play the poker wagering game may do so by placing a wager in the first pot without placing the second wager and without being eligible to win any award from the second pot. In some embodiments, the second wager may include multiple sub-wagers. For example, the second wager may include an ante wager, a first play wager, a second play wager, and a third play wager. In other embodiments, a third pot (not shown) for participating in a progressive side wager game is provided. Such third pots may be separate from the other pots or may be combined with one of the other pots. The second wager may be accepted, for example, by performing any of the acts described previously in connection with FIG. 1.

In some embodiments, the second pot may be a pooled or linked pot. For example, the second pot may include second wagers accepted from multiple concurrent wagering games, which may include only second wagers from those wagering games currently being played or may include accumulated second wagers from past wagering games. As specific, non-limiting examples, the second pot may include all second wagers accepted from a group of tables or local wagering game administration devices at a casino, from multiple groups of remote devices connected to network gaming architecture, or from both. In other embodiments, the second pot may not be pooled, and awards for the second wager may be limited to the amounts wagered at a respective table, local wagering game administration device, or group of remote devices.

A rake (e.g., a commission for the house) may be taken on at least one of the first and second wagers, as indicated at operation 206. For example, the house may collect a portion of the second wager at the time the second wager is placed or may collect a portion of amounts awarded from the second pot at the time the second pot or a portion of the second pot is awarded. The rake may comprise, for example, a fixed percentage of the second wager. More specifically, the percentage of the second wager collected for the rake may be, for example, greater than a theoretical house advantage for the underlying game. As another example, the rake may be less than an average house advantage for play of the wagering game by all players, including average and sub-average players, which may be calculated using a historical house advantage for the wagering game (e.g., a house advantage for the wagering game over the last five, ten, or fifteen years for a given casino or other gaming establishment). As specific, nonlimiting examples, the percentage of the second wager collected for the rake may be between 3% and 8%, between 4% and 7%, or between 5% and 6%. In other embodiments, the portion of the second wager collected for the rake may comprise a variable percentage of the second wager or may comprise a fixed quantity (e.g., a flat fee) irrespective of the total amount for the second wager, a fixed percentage with a cap, or a time-based fee for increments of time playing the wagering game.

In some embodiments, all profits for the house may be made from the rake. In such embodiments, all second wagers in excess of the rake may be redistributed back to the players, rather than be collected by the house as additional revenue. Such limiting of profits for the house and redistribution of second wagers back to the players may increase the attractiveness of the wagering game to both inexperienced and highly skilled players. Because the amount earned by the house is known, highly skilled players may perceive that their skill will enable them to increase winnings, and inexperienced players may be enticed by the possibility of winning the second pot or a portion thereof. In other embodiments, the house may make profits on the rake and on losses from one or more of the wagers (e.g., ante and play wagers), including losses resulting from optimal and suboptimal play. The rake may be maintained in a rake account, and profits for the house may be deducted from the rake account. The rake may be taken by, for example, electronically transferring funds from the second pot to a rake account (e.g., as instructed by a game server 606 (see FIG. 8) using casino account servers 610 (see FIG. 8)) or physically removing or exchanging money or representations of money from the second pot on a live table.

A round of the underlying wagering game may be played, as indicated at operation 208. For example, the underlying wagering game may be played at least substantially as described previously in connection with FIGS. 1 through 3. In one embodiment, an additional side wager is played between players, rather than against a pay table. The additional side wager may be a fixed amount, such as an amount equal to the ante wager. The additional side wager is added to a first pot that is completely distributed at the end of each round of play. The distribution of the additional side wager may be based, for example, on the highest player hand at the conclusion of the game. The ante and play wagers are added to a second progressive pot for distribution based on the pay table. In this way, the first pot allows the players to compete based on hand strength against other players, while the second pot is able to support larger progressive awards based on a pay table.

At the end of a round of play, the first wager may be resolved and at least a portion of the first pot may be awarded to at least one player, as indicated at operation 210. Each successive round of making wagers, dealing cards, and resolving wagers may constitute a round of play, and the first pot or a portion of the first pot may be awarded to at least one player at the end of each round of play. The player to whom the first pot or the portion of the first pot is awarded may hold a winning hand or at least a tying hand for that round of play according to the rules of the underlying wagering game. Awarding the first pot or the portion of the first pot may comprise crediting a player account of each wining player or may comprise distributing physical money or physical representations of money to each winning player.

In some embodiments, an entire amount of the first pot may be awarded to at least one player at the end of each round of play. In such embodiments, the first pot may be a non-progressive pot. Awarding the entire first pot to at least one player at the end of each round of play may enable the wagering game to qualify as a legal form of online "poker" play under some relevant statutes. For example, games that require a mandatory pot bet that may or may not be raked, that have no house advantage, and that put all other bets into a second pot that is raked may qualify as "poker" to gaming authorities, especially for online versions of the games. Awarding the entire amount of a first pot to at least one player at the end of each round of play redistributes lost first wagers attributable to suboptimal play to other players, rather than to the house. Accordingly, such a wagering game may be particularly attractive to players who perceive themselves as being highly skilled in the wagering game and, therefore, more able to take advantage of suboptimal play by other players. In some embodiments, a portion of the first pot may be awarded to at least one player at the end of each round of play. For example, the house may take a rake on the first wager, which may still enable the wagering game to qualify as a legal form of online gambling under some relevant statutes. The rake taken may comprise, for example, between 1% and 8%, between 2% and 6%, or between 3% and 5% of the first wager. The rake amounts on each wager may be more than, less than, or equal to the rake taken on other wagers in some embodiments. In still other embodiments, a portion of the first pot may remain in the first pot or be redistributed to another pot (e.g., the second pot) to be awarded in a subsequent round of play as a progressive payout or a dividend distribution. In such an example, the portion of the wager remaining in the first pot or redistributed to another pot may comprise, for example, a fixed percentage of the first wager, a variable percentage of the first wager (e.g., an odds payout may be awarded and the remainder retained in the first pot or redistributed to the other pot), or a fixed amount.

In lieu of, or in addition to, a rake taken on one or more wagers or from winnings, the house may be compensated in a number of other ways, including, without limitation, a flat fee per round of play, a percentage of wagers made with or without a cap, rental of a player "seat," or otherwise as is known in the gaming art. All such compensation may be generally referred to as a "commission."

All or portions of the second pot are distributed when there is a qualifying event, as indicated by operation 212. In embodiments in which the second pot is a progressive pot, at least a portion of the second pot may be awarded to at least one player when a predetermined non-premium winning hand combination is dealt, as indicated at operation 214, or when a premium winning hand composition is dealt, as indicated at operation 216. The second pot may not be awarded at the end of each round of play, but may grow during each successive round in which no player is dealt a premium winning hand combination. Awarding the second pot or a portion of the second pot may comprise crediting a player account with funds from the second pot or may comprise distributing physical money or physical representations of money from the pot to the player. In some embodiments involving a no-house-advantage first pot awarded at the end of each round and a progressive second pot that receives all other game bets, all players participating in the wagering game who have made the second pot wager may be eligible to win the second pot or a portion of the second pot. Players who are ineligible to win the first pot, and players who have folded but still have one or more other active bets in play, may be eligible to win the second pot or a portion of the second pot.

A predetermined winning hand combination may comprise, for example, a four-of-a-kind, a full house, a flush, a straight, a three-of-a-kind, two pair, or one pair. The hands qualifying as new winning hand combinations may be predetermined at the beginning of each round of play in some embodiments. In other embodiments, new winning hand combinations may be predetermined at the beginning of play and may remain fixed until at least one player achieves a predetermined winning hand combination, at which time new winning hand combinations may be predetermined. In still other embodiments, the hand combinations qualifying as winning hand combinations may be predetermined at the outset of the wagering game and remain fixed for the duration of the wagering game. The hands qualifying as winning hand combinations may be predetermined at random from a list of possible winning hand combinations, from among a schedule with a fixed rotation of possible winning hand combinations, or using a fixed table of winning hand combinations.

A premium winning hand composition may comprise, for example, a four-of-a-kind, a straight flush, a royal flush, or a royal flush of a certain suit. The hand compositions qualifying as premium winning hand compositions may remain fixed throughout the duration of the wagering game or may change during the wagering game. For example, after a player has achieved a premium winning hand composition, the hand compositions qualifying as premium winning hand compositions may be made more restrictive or less restrictive. As a specific, nonlimiting example, after a player has achieved a straight flush, the hand compositions qualifying as premium winning hand compositions may be restricted to royal flushes or may be expanded to include four-of-a-kinds. The hands qualifying as premium winning hand compositions may be predetermined at random from a list of possible premium winning hand compositions, following a schedule with a fixed rotation of possible premium winning hand compositions, or according to a fixed table of premium winning hand compositions.

In embodiments in which the second pot is a progressive pot, the amount awarded from the second pot for achieving a premium winning hand composition may be a progressive payout at least as great as a maximum progressive payout for achieving a predetermined winning hand composition. For example, the entire second pot may be awarded when a player or multiple players are dealt a premium winning hand composition, and only a portion of the second pot may be awarded when a player or multiple players are dealt a predetermined winning hand combination.

In embodiments, the qualifying event at operation 212 is based on a predetermined event that is not based on hand composition. In embodiments in which the amount of the second pot is adjusted using a dividend refund method, the second pot, less the rake, may be distributed among the players upon the occurrence of a predetermined event. The predetermined event may not be based, for example, on player skill or chance events occurring in the underlying wagering game. The predetermined event may comprise, for example, the expiration of a time limit or the amount of the pot reaching a certain threshold amount. The pot, which has already been raked, less a minimum seed amount, is divided pro-rata between players who are currently participating, to players who contributed to the pot, or to players according to another distribution method. The distribution can take the form of a debit to a player account, and the distribution does not take place as part of a game play event. Players may receive dividend refunds on play conducted on a live gaming table, on a game administered by an electronic gaming machine, or on a game administered by a remote gaming device.

In some embodiments, the dividend distributions may not be paid to players who have not contributed to the second pot since the last dividend distribution was paid. The percentage of the second pot, less the rake, paid to each player as a dividend distribution may be, for example, approximately equal to the percentage of hands won by each player, the percentage of first pot winnings won by each player, the percentage of total amounts wagered by each player, the proportional number of wagers made by each player, the proportional length of time spent playing the wagering game by each player, or an equal percentage for each player eligible to receive a dividend distribution from the second pot.

Alternatively, the second pot and/or any other pots may be distributed (wholly or partially) in response to a predetermined event or condition. The predetermined event or condition may be time-based, pot-based (or pool-based), game-based, or other. Further details on pot distributions based on predetermined events and conditions are disclosed in the U.S. patent application Ser. No. 13/871,824, filed Apr. 26, 2013, titled "Distributing Supplemental Pot in Wagering Games Based on Predetermined Event" (now U.S. Patent Application Publication No. 2013/0296025 A1, published Nov. 7, 2013), the disclosure of which is incorporated herein in its entirety by this reference.

In some embodiments, the second pot may be seeded with money from the rake account or reserve account at the beginning of play, after the second pot or a portion of the second pot has been awarded, or both. For example, the second pot may be seeded from the rake account of the house, and the house may maintain an amount of funds in the rake account sufficient to significantly reduce (e.g., to essentially eliminate) the likelihood that any payouts made from the rake account and any seeding amounts withdrawn from the rake account exhaust or overdraw the rake account. In some embodiments, a casino reserve account may be provided to fill the rake account in the event of an overdraw. Such seeding may incentivize players to participate in the wagering game and specifically to place the second wager to be eligible for the second pot. In addition, such seeding may reduce the likelihood that the amount of funds in the second pot may be insufficient to cover all the payouts to players. For example, where a player achieves a premium winning hand composition in one round of play, a player achieves a predetermined winning hand combination in the immediately following round of play, and a fixed odds payout is to be awarded to the player holding the predetermined winning hand combination, the amount seeded to the second pot between those rounds of play may be at least as great as the maximum fixed odds payout awardable for any predetermined winning hand combination. The second pot may be seeded each time the second pot is awarded in its entirety or each time the amount in the second pot is lower than the maximum fixed odds payout.

As a specific, nonlimiting example, a player-banked wagering game may comprise receiving an ante wager and additional side wager from a plurality of players. The additional side wager is added to a first poker pot that is not raked, has no house advantage, and is completely distributed to the players after each round. The ante wager and any subsequent play wagers may be added to a second game pot having a progressive payout for achieving a predetermined rank, such as a rank listed on a pay table as described above. After placing the ante wager and, optionally, an additional side wager, the game is played as described above. Additional wagers in the hand are added to the second pot. After completing the hand, the first pot is awarded to the player remaining in the hand with the highest hand. The second pot is a progressive pot and awards a hand that matches a pay table.

As another specific, nonlimiting example, a player-banked wagering game may comprise receiving an ante wager and additional side wager from a plurality of players. The additional side wager is added to a first pot that is not raked, has no house advantage, and is completely distributed to the players after each round. The ante wager and any play wagers are added to a second pot having a dividend payout for reaching a predetermined event. After placing the ante wager and additional side wager, the play of a game round is provided as described above. Any additional wagers are added to the second pot. After completing the hand, the first pot is awarded to the player remaining in the hand with the highest hand. The second pot is a progressive pot and awards a distribution from the second pot based on a predetermined event. The predetermined event may be selected from the group consisting of participating for a predetermined number of hands, completing a predetermined number of rounds, reaching a predetermined time limit, or reaching a predetermined amount in the second pot.

In some embodiments, wagering games may be played without risking money in connection with the wagers (i.e., "play-for-fun" games). Access to play-for-fun wagering games may be granted on a time period basis in some embodiments. For example, upon initially joining the wagering game, each player may automatically be given wagering elements, such as, for example, chips, points, or simulated currency, that is of no redeemable value. After joining, the player may be free to place wagers using the wagering elements, and a timer may track how long the player has been participating in the wagering game. If the player exhausts his or her supply of the wagering elements before a predetermined period of time has expired, the player may simply wait until the period of time passes to rejoin the game and receive another quantity of the wagering elements to resume participation in the wagering game.

In some embodiments, a hierarchy of players may determine the quantity of wagering elements given to a player for each predetermined period of time. For example, players who have been participating in the wagering game for a longer time, who have played closest to optimal strategy for the game, who have won the largest percentage of wagers, or who have won the largest quantities of wagering elements from their wagers may be given more wagering elements for each allotment of time than players who have newly joined, who have played according to poor strategy, who have lost more frequently, or who have lost larger quantities of wagering elements. In some embodiments, the hierarchy of players may determine the duration of each allotment of time. For example, players who have been participating in the wagering game for a longer time, who have played closest to optimal strategy for the game, who have won the largest percentage of wagers, or who have won the largest quantities of wagering elements from their wagers may be given shorter allotments of times to wait after exhausting their supply of wagering elements than players who have newly joined, who have played according to poor strategy, who have lost more frequently, or who have lost larger quantities of wagering elements. In some embodiments, players who have not run out of wagering elements after the period of time has expired may have the balance of their wagering elements reset for a subsequent allotment of time. In other embodiments, players who have not run out of wagering elements may retain their remaining wagering elements for subsequent allotments of time and may receive additional wagering elements corresponding to the new allotment of time to further increase the balance of wagering elements at their disposal. Players may be assigned to different categories of players, which determine the number of wagering elements awarded. In a given period of time, higher-level players or players who have invested more time playing the game may earn more wagering elements per unit of time than a player assigned to a lower level group.

In some embodiments, a player may be permitted to redeem an access token of no redeemable face value, such as, for example, points associated with a player account (e.g., social media account credits, online points associated with a transacting account, etc.), to compress the period of time and receive more wagering elements. The access tokens may be purchased or may be obtained without directly exchanging money for the access tokens. For example, access tokens may be acquired by participating in member events (e.g., completing surveys, receiving training on how to play the wagering game, sharing information about the wagering game with others), spending time participating in the wagering game or in a player account forum (e.g., logged in to a social media account), or viewing advertising. Thus, an entity administering play-for-fun wagering games may not receive money from losing player wagers or may not take a rake on wagers, but may receive compensation through advertising revenue or through the purchase of access tokens redeemable for time compressions to continue play of the wagering game or simply to increase the quantity of wagering elements available to a player.

After a player has stopped participating in a play-for-fun wagering game, any remaining quantities of the wagering elements may be relinquished by the player, in some embodiments. For example, logging out of a play-for-fun wagering game administered over the Internet may cause any remaining wagering elements associated with a respective player to be lost. Thus, when the player rejoins the play-for-fun wagering game, the quantity of wagering elements given to the player for an allotment of time may not bear any relationship to the quantity of wagering elements held by the player when he or she quit playing a previous session of the wagering game. In other embodiments, the quantity of wagering elements held by a player when stopping participation may be retained and made available to the player, along with any additional quantities of wagering elements granted for new allotments of time, when rejoining the wagering game.

Figure 5:
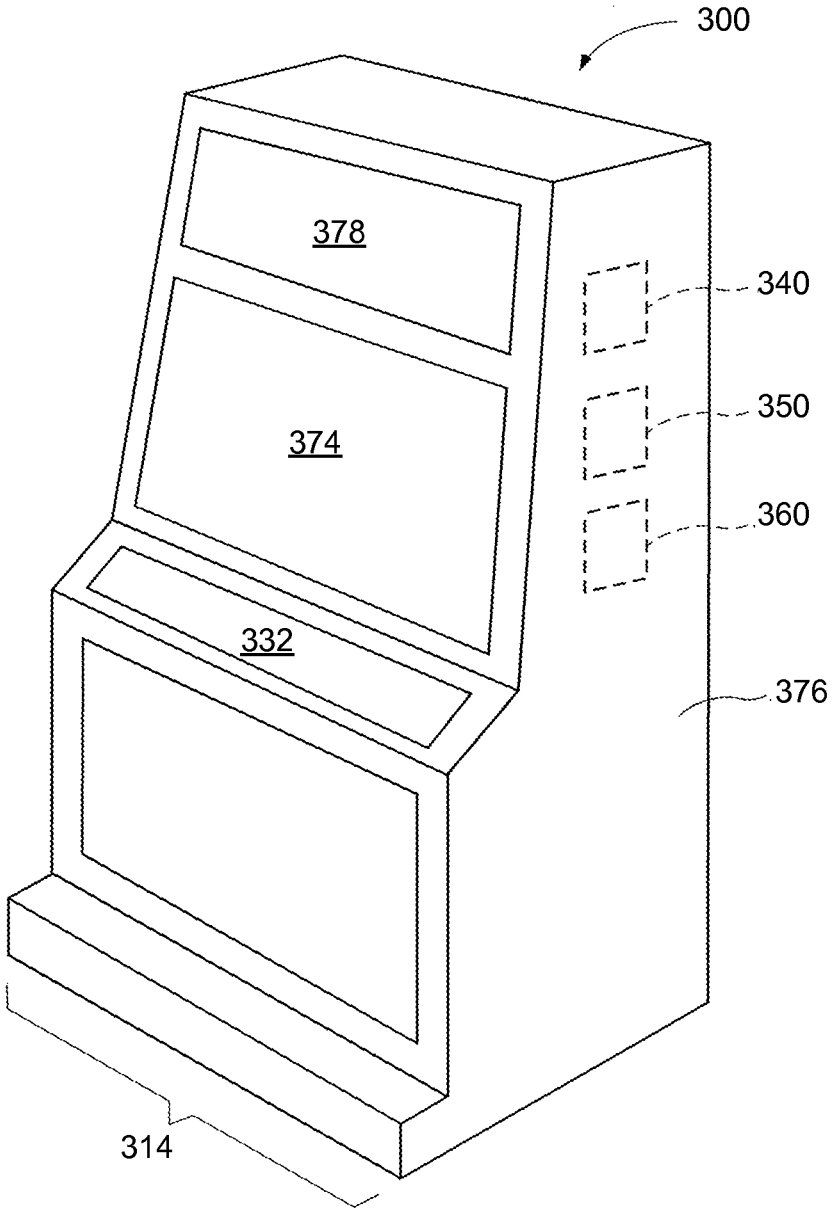
FIG. 5 is a perspective view of an individual electronic gaming device configured for implementation of embodiments of wagering games.

Referring to FIG. 5, shown is an example of an individual electronic gaming device 300 configured for implementation of embodiments of wagering games according to the present disclosure. The individual electronic gaming device 300 may include an individual player position 314 that includes a player input area 332 for a player to interact with the individual electronic gaming device 300 through various input devices (not shown). The individual electronic gaming device 300 may include a gaming screen 374 configured to display indicia for interacting with the individual electronic gaming device 300, such as through processing one or more programs stored in memory 340 to implement the rules of game play at the individual electronic gaming device 300. Accordingly, game play may be accommodated without involving physical playing cards, poker chips, and/or live personnel. The action may instead be simulated by a control processor 350 operably coupled to the memory 340 and interacting with and controlling the individual electronic gaming device 300. Although the figure has an outline of a traditional gaming cabinet, the individual electronic gaming device 300 may be implemented in any number of ways, including, but not limited to, client software downloaded to a portable device, such as a smartphone, a tablet, or a laptop personal computer. The individual electronic gaming device 300 may also be a non-portable personal computer (e.g., a desktop or an all-in-one computer) or another computing device. In some embodiments, client software is not downloaded but is native to the individual electronic gaming device 300 or is otherwise delivered with the individual electronic gaming device 300 when received by a player.

A communication device 360 may be included and operably coupled to the control processor 350 such that information related to operation of the individual electronic gaming device 300, information related to the game play, or combinations thereof may be communicated between the individual electronic gaming device 300 and other devices (not shown) through a suitable communication media, such as, for example, wired networks, Wi-Fi networks, and cellular communication networks.

The gaming screen 374 may be carried by a generally vertically extending cabinet 376 of the individual electronic gaming device 300. The individual electronic gaming device 300 may further include banners (not shown) configured to communicate rules of game play and/or the like, such as along a top portion 378 of the cabinet 376 of the individual electronic gaming device 300. The individual electronic gaming device 300 may further include additional decorative lights (not shown) and speakers (not shown) for transmitting and/or receiving sounds during game play. Further detail of an example of the individual electronic gaming device 300 (as well as other embodiments of tables and devices) is disclosed in U.S. patent application Ser. No. 13/215,156, filed Aug. 22, 2011, (published as U.S. Patent Application Publication No. 2013/0053117 A1 on Feb. 28, 2013), now abandoned, the disclosure of which is incorporated herein in its entirety by this reference.

Some embodiments may be implemented at locations that include a plurality of player stations. Such player stations may include an electronic display screen for display of game information, such as displaying virtual cards, virtual chips, and game instructions, and for accepting wagers and facilitating credit balance adjustments. Such player stations may, optionally, be integrated in a table format, may be distributed throughout a casino or other gaming site, or may include both grouped and distributed player stations. While some features may be automated through electronic interfaces (e.g., virtual cards, virtual chips, etc.), some features may remain in the physical domain. As such, the game play may be administered by a live dealer, a virtual dealer, or a combination of both.

Figure 6:
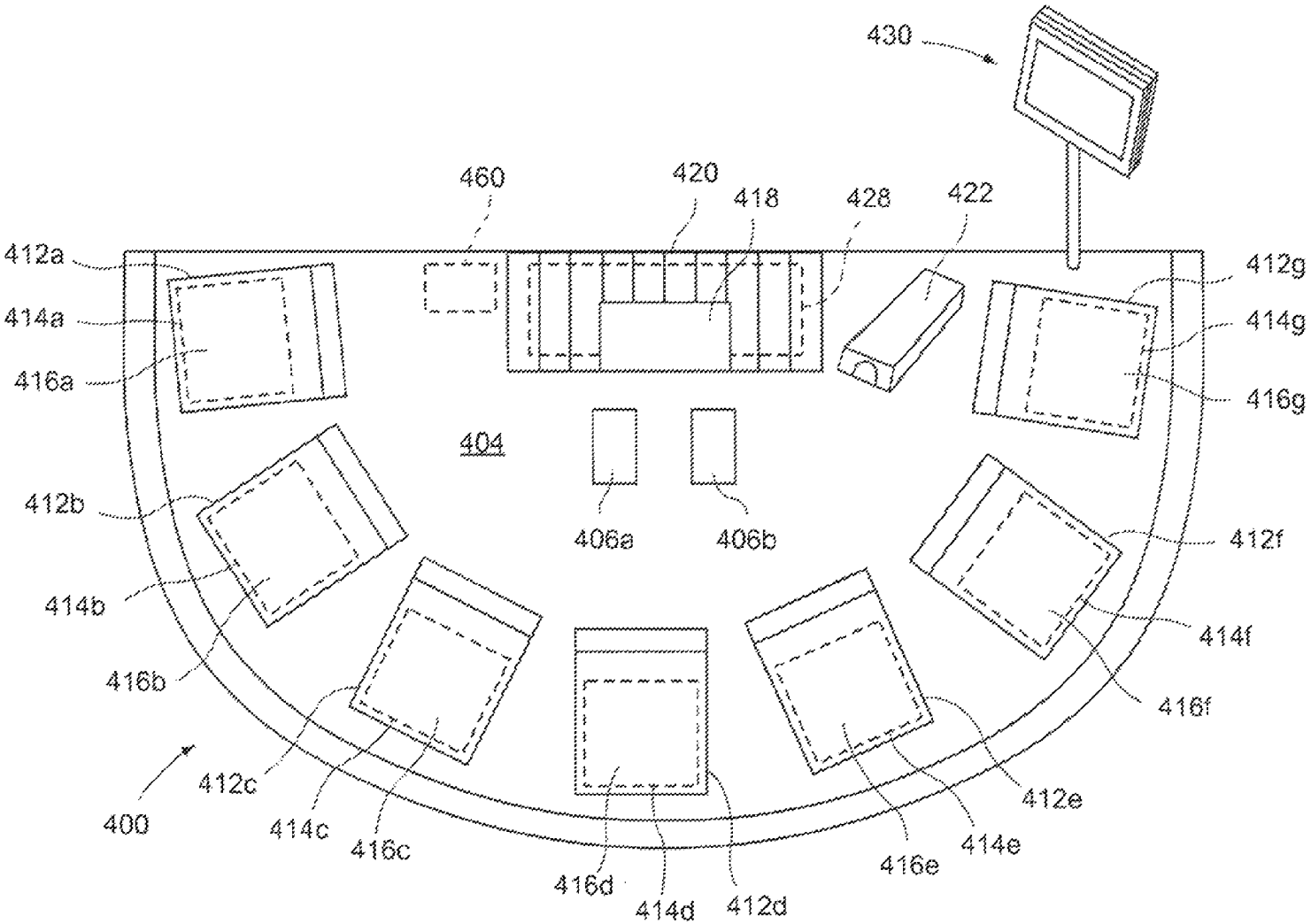
FIG. 6 is a top view of a suitable table configured for implementation of embodiments of wagering games.

Referring to FIG. 6, shown is an example of a suitable table 400 configured for implementation of embodiments of wagering games according to the present disclosure. The table 400 may include a playing surface 404. The table 400 may include a plurality of player stations 412*a* through 412*g*. Each player station 412*a* through 412*g* may include a player interface 416*a* through 416*g*, which may be used for displaying game information (e.g., game instructions, input options, wager information including virtual chips, game outcomes, etc.). The player interface 416*a* through 416*g* may include a display screen in the form of a touch screen, which may be at least substantially flush with the playing surface 404 in some embodiments. Each player interface 416*a* through 416*g* may be coupled respectively with its own local game processor 414*a* through 414*g* (shown in dashed lines), although, in some embodiments, a central game processor 428 (shown in dashed lines) may be employed and communicate directly to the player interfaces 416*a* through 416*g*. In some embodiments, a combination of the individual local game processors 414*a* through 414*g* and the central game processor 428 may be employed.

A communication device 460 may be included and operably coupled to one or more of the local game processors 414, the central game processor 428, or combinations thereof, such that information related to operation of the table 400, information related to the game play, or combinations thereof may be communicated between the table 400 and other devices (not shown) through a suitable communication media, such as, for example, wired networks, Wi-Fi networks, and cellular communication networks.

The table 400 may further include additional features, such as a dealer chip tray 420, which may be used by the dealer to cash players in and out of the wagering game, whereas wagers and balance adjustments during game play may be performed using virtual chips. For embodiments using physical cards 406*a* and 406*b*, the table 400 may further include a card handling device 422 that may be configured to shuffle, read, and deliver physical cards for the dealer and players to use during game play or, alternatively, a card shoe configured to read and deliver cards that have already been randomized. For embodiments using virtual cards, such virtual cards may be displayed at the individual player interfaces 416*a* through 416*g*. Common virtual cards may be displayed in a common card area (not shown).

The table 400 may further include a dealer interface 418, which, like the player interfaces 416*a* through 416*g*, may include touch screen controls for assisting the dealer in administering the wagering game. The table 400 may further include an upright display 430 configured to display images that depict game information, such as pay tables, hand counts, historical win/loss information by player, and a wide variety of other information considered useful to the players. The upright display 430 may be double sided to provide such information to players as well as to the casino pit.

Further detail of an example of a table and player displays is disclosed in U.S. Patent Application Pub. No. 2010/0016050, filed Jul. 15, 2008, published Jan. 21, 2010 (now U.S. Pat. No. 8,262,475, issued Sep. 11, 2012), titled "Chipless Table Split Screen Feature," the disclosure of which is incorporated herein in its entirety by this reference. Although an embodiment is described showing individual discrete player stations 412*a* through 412*g*, in some embodiments, the entire playing surface 404 may be an electronic display that is logically partitioned to permit game play from a plurality of players for receiving inputs from, and displaying game information to, the players, the dealer, or both.

Figure 7:
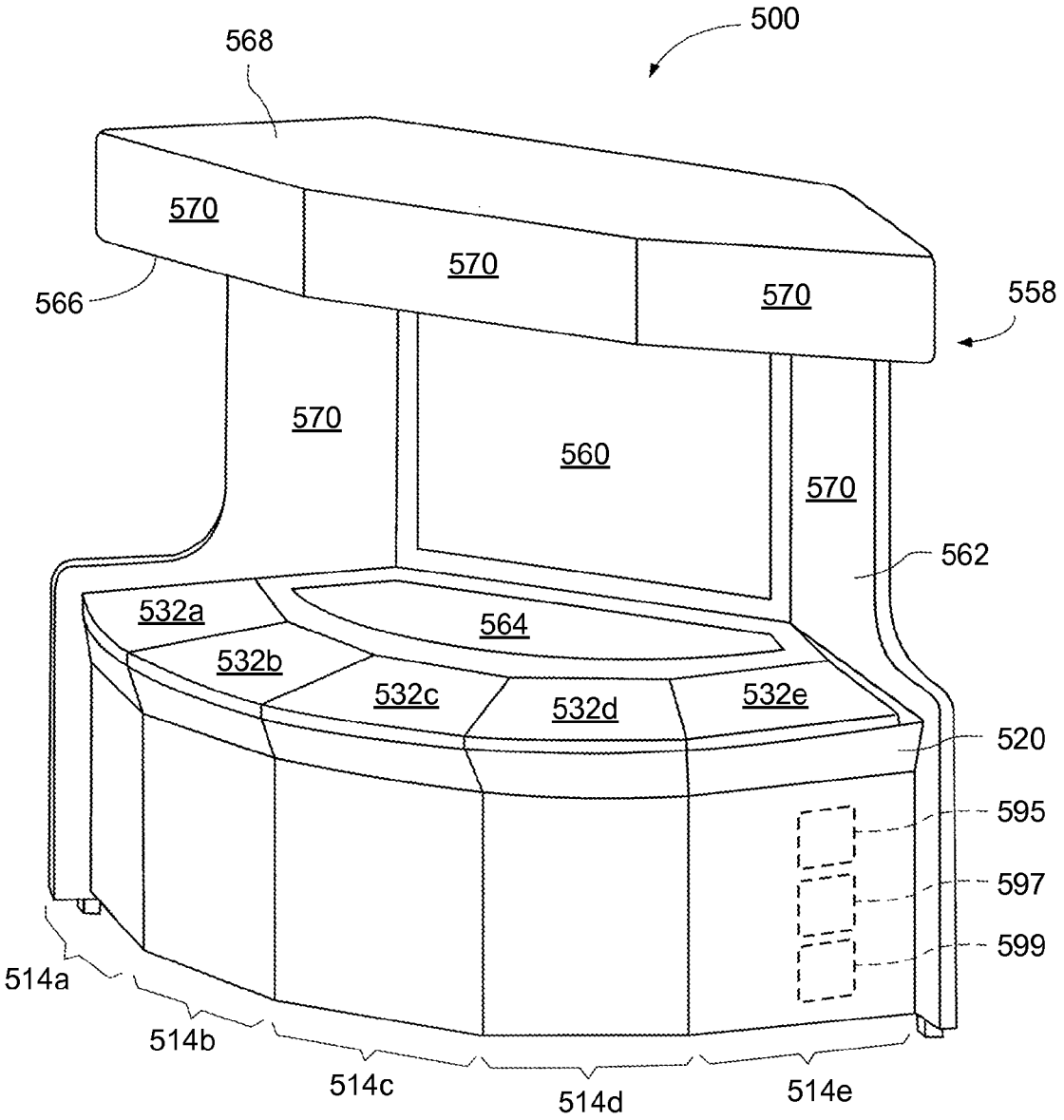
FIG. 7 is a perspective view of another embodiment of a suitable table configured for implementation of embodiments of wagering games having a virtual dealer.

Referring to FIG. 7, shown is another example of a suitable table 500 configured for implementation of embodiments of wagering games having a virtual dealer according to the present disclosure. The table 500 may include player positions 514*a* through 514*e* that are arranged in a bank about an arcuate edge 520 of a video device 558 that may comprise a card screen 564 and a dealer screen 560. The dealer screen 560 may display a video simulation of the dealer (i.e., a virtual dealer) for interacting with the video device 558, such as through processing one or more stored programs stored in memory 595 to implement the rules of game play at the video device 558. The dealer screen 560 may be carried by a generally vertically extending cabinet 562 of the video device 558. The card screen 564 may be configured to display at least one or more of the dealer's cards, the community cards, and/or the player's cards by the virtual dealer on the dealer screen 560 (virtual dealer not shown in FIG. 7).

Each of the player positions 514*a* through 514*e* may include a player interface area 532*a* through 532*e*, which is configured for wagering and game play interactions with the video device 558 and/or the virtual dealer. Accordingly, game play may be accommodated without involving physical playing cards, poker chips, and/or live personnel. The action may, instead, be simulated by a control processor 597 interacting with and controlling the video device 558. The control processor 597 may be located internally within, or otherwise proximate to, the video device 558. The control processor 597 may be programmed, by known techniques, to implement the rules of game play at the video device 558. As such, the control processor 597 may interact and communicate with display/input interfaces and data entry inputs for each player interface area 532*a* through 532*e* of the video device 558. Other embodiments of tables and gaming devices may include a control processor that may be similarly adapted to the specific configuration of its associated device.

A communication device 599 may be included and operably coupled to the control processor 597 such that information related to operation of the table 500, information related to the game play, or combinations thereof may be communicated between the table 500 and other devices (not shown) through a suitable communication media, such as, for example, wired networks, Wi-Fi networks, and cellular communication networks.

The video device 558 may further include banners (not shown) configured to communicate rules of play and/or the like, which may be located along one or more walls 570 of the cabinet 562. The video device 558 may further include additional decorative lights (not shown) and speakers (not shown), which may be located on an underside surface 566, for example, of a generally horizontally depending top 568 of the cabinet 562 of the video device 558 generally extending toward the player positions 514*a* through 514*e*.

Further detail of an example of a table and player displays is disclosed in U.S. Patent Application Publication No. 2005/0164762, filed Jan. 26, 2004, published Jul. 28, 2005, titled "Automated Multiplayer Game Table with Unique Image Feed of Dealer" (now U.S. Pat. No. 8,272,958, issued Sep. 25, 2012), the disclosure of which is incorporated herein in its entirety by this reference. Although an embodiment is described showing individual discrete player stations, in some embodiments, the entire playing surface (e.g., the player interface areas 532*a* through 532*e*, the card screen 564, etc.) may be an electronic display that is logically partitioned to permit game play from a plurality of players for receiving inputs from, and displaying game information to the players, the dealer, or both.

Figure 8:
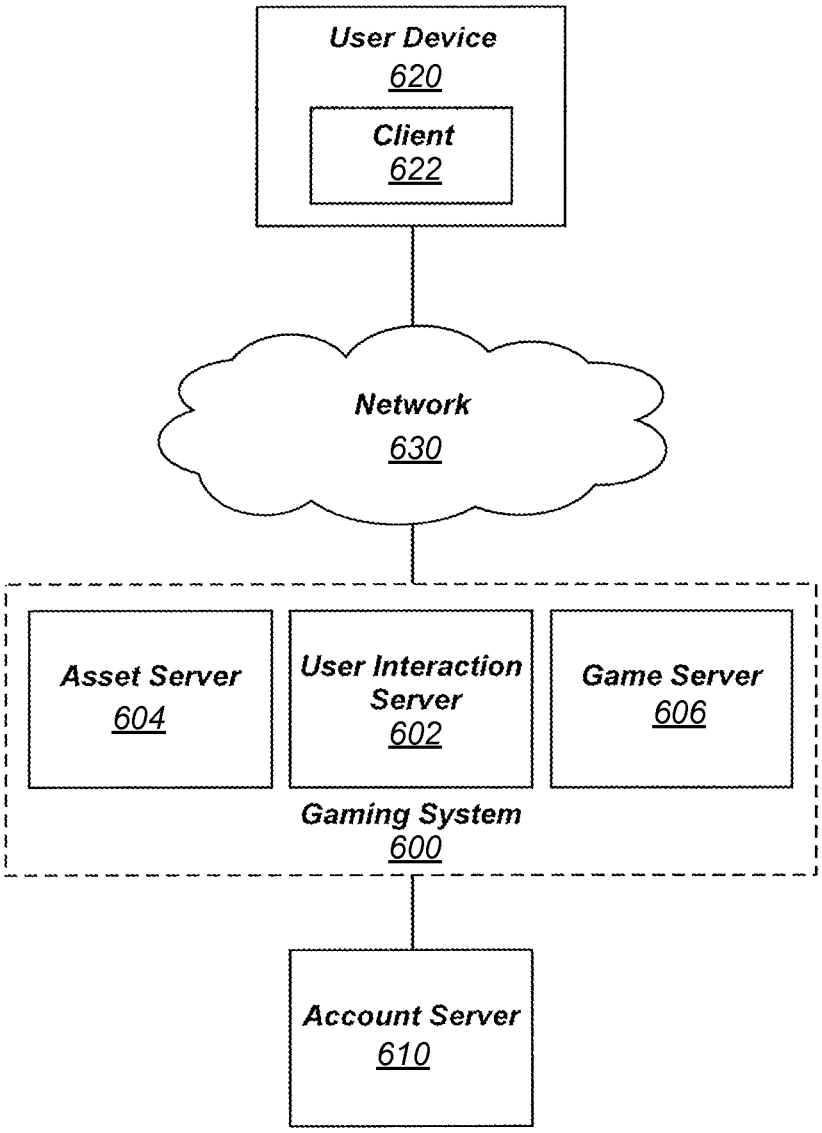
FIG. 8 is a schematic block diagram of a gaming system for implementing embodiments of wagering games.

Wagering games, in accordance with embodiments of the disclosure, may be administered over the Internet, or otherwise online, in one embodiment using a gaming system employing a client server architecture. Referring to FIG. 8, shown is a schematic block diagram of a gaming system 600 for implementing wagering games according to an embodiment. The gaming system 600 enables end users to access proprietary and/or non-proprietary game content. Such game content may include, without limitation, various types of wagering games, such as card games, dice games, big wheel games, roulette, scratch off games ("scratchers"), and any other wagering game in which the game outcome is determined, in whole or in part, by one or more random events. This includes, but is not be limited to, Class II and Class III games as defined under 25 U.S.C. §2701 et seq. ("Indian Gaming Regulatory Act"). Such games may include banked and/or non-banked games.

The wagering games supported by the gaming system 600 may be operated with real currency or with virtual credits or other virtual (e.g., electronic) value indicia. For example, the real currency option may be used with traditional casino and lottery-type wagering games in which money or other items of value are wagered and may be cashed out at the end of a game session. The virtual credits option may be used with wagering games in which credits (or other symbols) may be issued to a player to be used for the wagers. A player may be credited with credits in any way allowed, including, but not limited to, a player purchasing credits; being awarded credits as part of a contest or a win event in this or another game (including non-wagering games); being awarded credits as a reward for use of a product, casino, or other enterprise, for time played in one session, or for games played; or simply being awarded virtual credits upon logging in at a particular time or with a particular frequency, etc. Although credits may be won or lost, the ability of the player to cash out credits may be controlled or prevented. In one example, credits acquired (e.g., purchased or awarded) for use in a play-for-fun game may be limited to non-monetary redemption items, awards, or credits usable in the future or for another game or gaming session. The same credit redemption restrictions may be applied to some or all of credits won in a wagering game as well.

An additional variation includes web-based sites having both play-for-fun and wagering games, including issuance of free (non-monetary) credits usable to play the play-for-fun games. This may attract players to the site and to the games before the players engage in wagering. In some embodiments, a limited number of free or promotional credits may be issued to entice players to play the games. Another method of issuing credits includes issuing free credits in exchange for identifying friends who may want to play. In another embodiment, additional credits may be issued after a period of time has elapsed to encourage the player to resume playing the game. The system may enable players to buy additional game credits to allow the player to resume play. Objects of value may be awarded to play-for-fun players, which objects of value may or may not be in a direct exchange for credits. For example, a prize may be awarded or won for a highest scoring play-for-fun player during a defined time interval. All variations of credit redemption are contemplated, as desired by game designers and game hosts (the person or entity controlling the hosting systems).

The gaming system 600 may include a gaming platform that establishes a portal for an end user to access a wagering game hosted by a game server 606 through a user interaction server 602. A user device 620 may communicate with the user interaction server 602 of the gaming system 600 using a network 630 (e.g., the Internet). The user interaction server 602 may communicate with the game server 606 and provide game information to the user. In some embodiments, the game server 606 may also be a game engine. In some embodiments, a single user device 620 communicates with a game provided by the game server 606, while other embodiments may include a plurality of user devices 620 configured to communicate and provide end users with access to the same game provided by the game server 606. In addition, a plurality of end users may access a single user interaction server 602, or a plurality of user interaction servers 602, to access the game server 606.

The user interaction server 602 may communicate with the user device 620 to enable access to the gaming system 600. The user interaction server 602 may enable a user to create and access a user account and interact with the game server 606. The user interaction server 602 may enable users to initiate new games, join existing games, and interface with games being played by the user.

The user interaction server 602 may also provide a client 622 for execution on the user device 620 for accessing the gaming system 600. The client 622, provided by the gaming system 600 for execution on the user device 620, can comprise a variety of implementations according to the user device 620 and method of communication with the gaming system 600. In one embodiment, the user device 620 connects to the gaming system 600 using a web browser, and the client 622 executes within a browser window or frame of the web browser. In another embodiment, the client 622 is a standalone executable on the user device 620.

In one embodiment, the client 622 may comprise a relatively small amount of script (e.g., JAVASCRIPT®), also referred to as a "script driver," including scripting language that controls an interface of the client 622. The script driver may include simple function calls requesting information from the gaming system 600. In other words, the script driver stored in the client 622 may merely include calls to functions that are externally defined by, and executed by, the gaming system 600. As a result, the client 622 may be characterized as a "thin client." As that term is used herein, the client 622 may be little more than a script player. The client 622 may simply send requests to the gaming system 600 rather than perform logic itself. The client 622 receives player inputs, and the player inputs are passed to the gaming system 600 for processing and executing the wagering game. In one embodiment, this includes providing specific graphical display information to the client 622, as well as game outcomes.

In other embodiments, the client 622 comprises an executable file rather than a script. In that case, the client 622 may do more local processing than does a script driver, such as calculating where to show what game symbols upon receiving a game outcome from the game server 606 through the user interaction server 602. In one embodiment, it may be that portions of an asset server 604 are loaded onto the client 622 and are used by the client 622 in processing and updating graphical displays. Due to security and integrity concerns, most embodiments will have the bulk of the processing of the game play performed in the gaming system 600. However, some embodiments may include significant game processing by the client 622 when the client 622 and the user device 620 are considered trustworthy or when there is reduced concern for security and integrity in the displayed game outcome. In most embodiments, it is expected that some form of data protection, such as end-to-end encryption, will be used when data is transported over the network 630. The network 630 may be any network, including, but not limited to, the Internet.

In an embodiment in which the client 622 implements further logic and game control methodology beyond a thin client, the client 622 may parse and define player interactions prior to passing the player interactions to the gaming system 600. Likewise, when the client 622 receives a gaming interaction from the gaming system 600, the client 622 may be configured to determine how to modify the display as a result of the gaming interaction. The client 622 may also allow the player to change a perspective or otherwise interact with elements of the display that do not change aspects of the game.

In one form of the invention, the client 622 is part of an online casino that enables game play on the gaming system 600 by players playing on the user device 620. The client 622 provides a portal to the gaming system 600, and the player may not be aware that a game that is being played on the online casino is being administered by the gaming system 600. In other embodiments, the gaming system 600 is an integral part of the online casino. In other embodiments, the gaming system 600 is operated by a different entity than the entity that operates the online casino.

The gaming system 600 may include the asset server 604, which may host various media assets (e.g., audio, video, and image files) that may be sent to the client 622 for presenting the various wagering games to the end user. In other words, in this embodiment the assets presented to the end user may be stored separately from the client 622. In one embodiment, the client 622 requests the assets appropriate for the game played by the user; in other embodiments, especially those using thin clients, just those assets that are needed for a particular display event will be sent by the game server 606 when the game server 606 determines they are needed, including as few as one asset. In one example, the client 622 may call a function defined at the user interaction server 602 or the asset server 604, which may determine which assets are to be delivered to the client 622 as well as how the assets are to be presented by the client 622 to the end user. Different assets may correspond to the various clients that may have access to the game server 606 or to different games to be played.

The game server 606 is configured to perform game play methods and determine game play outcomes that are provided to the user interaction server 602 to be transmitted to the user device 620 for display on the end user's computer. For example, the game server 606 may include game rules for one or more wagering games, such that the game server 606 controls some or all of the game flow for a selected wagering game, as well as determine game outcomes. The game server 606 may include pay tables and other game logic. The game server 606 also performs random number generation for determining random game elements of the wagering game. In one embodiment, the game server 606 is separated from the user interaction server 602 by a firewall or other method of preventing unauthorized access to the game server 606 from the general members of the network 630.

The user device 620 may present a gaming interface to the player and communicate the user interaction to the gaming system 600. The user device 620 may be any electronic system capable of displaying gaming information, receiving user input, and communicating the user input to the gaming system 600. As such, the user device 620 can be a desktop computer, a laptop, a tablet computer, a set-top box, a mobile device, including, but not limited to, a smartphone, a kiosk, a terminal, or another computing device. The user device 620 may operate the client 622. When the user device 620 operates the client 622, the user device 620 may comprise the individual electronic gaming device 300 (see FIG. 5), as described above. The client 622 may be a specialized application or may be executed within a generalized application capable of interpreting instructions from the interactive gaming system 600, such as a web browser.

The client 622 may interface with an end user through a web page or an application that runs on a device, including, but not limited to, a smartphone, a tablet, or a general computer, or be any other computer program configurable to access the gaming system 600. The client 622 may be illustrated within a casino webpage (or other interface) indicating that the client 622 is embedded into a webpage, which is supported by a web browser executing on the user device 620.

In one embodiment, the gaming system 600 may be operated by different entities. The user device 620 and/or device housing the client 622 may be operated by a third party, such as a casino or an individual, that links to the gaming system 600, which may be operated, for example, by a wagering game service provider. Therefore, in some embodiments, the user device 620 and the client 622 may be operated by a different administrator than the operator of the game server 606. In other words, the user device 620 may be part of a third-party system that does not administer or otherwise control the gaming system 600 or the game server 606. In another embodiment, the user interaction server 602 and the asset server 604 are provided by a third-party system. For example, a gaming entity (e.g., a casino) may operate the user interaction server 602 or the user device 620 to provide its customers access to game content managed by a different entity, which may control the game server 606, amongst other functionality. In some embodiments, these functions are operated by the same administrator. For example, a gaming entity (e.g., a casino) may elect to perform each of these functions in-house, such as providing both the access to the user device 620 and the actual game content and providing administration of the gaming system 600.

The gaming system 600 may communicate with one or more external account servers 610, optionally through another firewall. For example, the gaming system 600 itself may not directly accept wagers or issue payouts. That is, the gaming system 600 may facilitate online casino gaming, but may not be part of a self-contained online casino itself. Instead, the gaming system 600 may facilitate the play of wagering games owned and controlled by a company offering games and gaming products and services, such as SHFL entertainment, Inc. Another entity (e.g., a casino or any account holder or financial system of record) may operate and maintain its external account servers 610 to accept bets and make payout distributions. The gaming system 600 may communicate with the account servers 610 to verify the existence of funds for wagering and instruct the account server 610 to execute debits and credits.

In some embodiments, the gaming system 600 may directly accept bets and make payout distributions, such as in the case where an administrator of the gaming system 600 operates as a casino. As discussed above, the gaming system 600 may be integrated within the operations of a casino rather than separating out functionality (e.g., game content, game play, credits, debits, etc.) among different entities. In addition, for play-for-fun wagering games, the gaming system 600 may issue credits, take bets, and manage the balance of the credits according to the game outcomes, but the gaming system 600 may not permit payout distributions or be linked to the account server 610 that permits payout distributions. Such credits may be issued for free, through purchase, or for other reasons, without the ability for the player to cash out. Such play-for-fun wagering games may be played on platforms that do not permit traditional gambling, such as to comply with jurisdictions that do not permit online gambling.

The gaming system 600 may be configured in many ways, from a fully integrated single system to a distributed server architecture. The asset server 604, the user interaction server 602, the game server 606, and the account server 610 may be configured as a single, integrated system of code modules running on a single server or machine, wherein each of the servers is functionally implemented on a single machine. In such a case, the functionality described herein may not be implemented as separate code modules. The asset server 604, the user interaction server 602, the game server 606, and the account server 610 may also be implemented as a plurality of independent servers, each using its own code modules running on a separate physical machine, and may further include one or more firewalls between selected servers (depending on security needs). Each server could communicate over some kind of networked connection, potentially as varied as that described for the network 630. Further, each single server shown in FIG. 8 may be implemented as a plurality of servers with load balancing and scalability factors built into the embodiment. All such embodiments and variations are fully contemplated.

Additional features may be supported by the game server 606, such as hacking and cheating detection, data storage and archival, metrics generation, messages generation, output formatting for different end user devices, as well as other features and operations. For example, the gaming system 600 may include additional features and configurations as described in U.S. patent application Ser. No. 13/353,194, filed Jan. 18, 2012, (published as U.S. Patent Application Publication No. 2013/0184079 A1 on Jul. 18, 2013) and U.S. patent application Ser. No. 13/609,031, filed Sep. 10, 2012 (published as U.S. Patent Application Publication No. 2013/0184059 A1 on Jul. 18, 2013), both titled "Network Gaming Architecture, Gaming Systems, and Related Methods," the disclosures of which are incorporated herein in their entirety by this reference.

The network 630 may enable communications between the user device 620 and the gaming system 600. A network (not shown) may also connect the gaming system 600 and the account server 610, and, further, one or more networks (not shown) may interconnect one or more of the other servers shown collectively as the gaming system 600. In one embodiment, the network 630 uses standard communications technologies and/or protocols. Thus, the network 630 can include links using technologies such as Ethernet, 802.11, worldwide interoperability for microwave access (WiMAX), 3G, digital subscriber line (DSL), asynchronous transfer mode (ATM), INFINIBAND®, PCI Express Advanced Switching, etc. Similarly, the networking protocols used on the network 630 can include multiprotocol label switching (MPLS), the transmission control protocol/Internet protocol (TCP/IP), the User Datagram Protocol (UDP), the hypertext transport protocol (HTTP), the simple mail transfer protocol (SMTP), the file transfer protocol (FTP), etc. The data exchanged over the network 630 can be represented using technologies and/or formats including the hypertext markup language (HTML), the extensible markup language (XML), etc. In addition, all or some of the links can be encrypted using conventional encryption technologies, such as secure sockets layer (SSL), transport layer security (TLS), virtual private networks (VPNs), Internet Protocol security (IPsec), etc. In another embodiment, the entities can use custom and/or dedicated data communications technologies instead of, or in addition to, the ones described above. Depending upon the embodiment, the network 630 can include links comprising one or more networks, such as the Internet.

Figure 9:
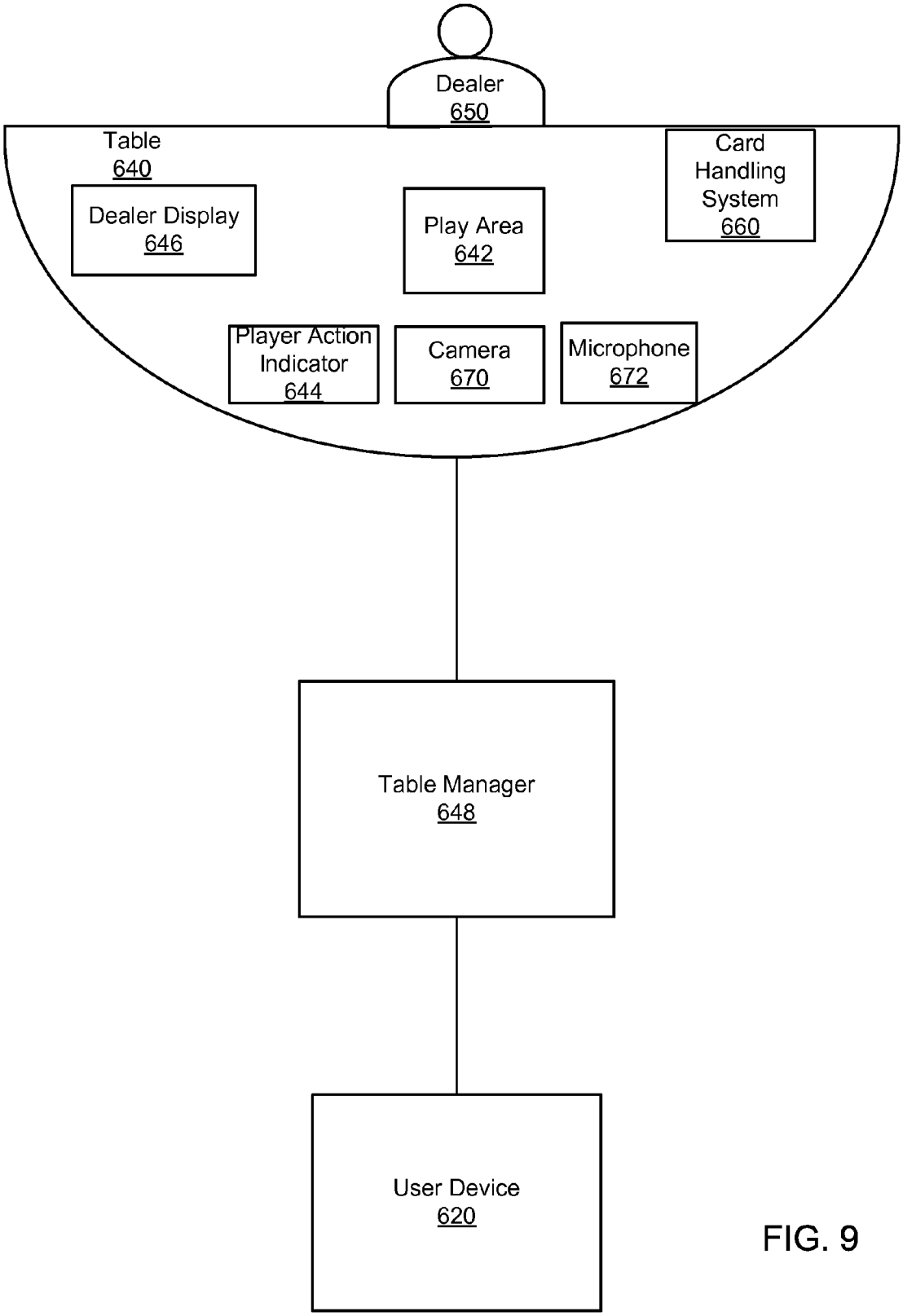
FIG. 9 is a schematic block diagram of a gaming system for implementing embodiments of wagering games including a live dealer feed.

FIG. 9 is a schematic block diagram of a gaming system for implementing embodiments of wagering games including a live dealer feed. Features of the gaming system 600 (FIG. 8) as described above are generally implemented by this embodiment, except as further described. In this embodiment, rather than cards being determined by a computerized random process, cards are dealt by a dealer 650 at a table 640 from a card handling system 660. A table manager 648 assists the dealer 650 in facilitating play of the game by transmitting a video feed of the actions of the dealer 650 to the user device 620 and transmitting player elections to the dealer 650. As described above, the table manager 648 communicates with the gaming system 600 (FIG. 8) to provide gaming at the table 640 to users of the gaming system 600. Thus, the table manager 648 communicates with the user device 620 through a network and may be a part of a larger online casino or may be operated as a separate system that facilitates game play. In various embodiments, each table 640 is managed by an individual table manager 648 constituting a gaming device, which receives and processes information relating to that table 640. For simplicity of description, these functions are described as being performed by the table manager 648, though certain functions may be performed by an intermediary gaming system 600 (FIG. 8). In some embodiments, the gaming system 600 may match players to the tables 640 and facilitate transfer of information between user devices 620 and gaming devices, such as wagering amounts and player action elections, but does not manage gameplay at individual tables 640. In other embodiments, functions of the table manager 648 are incorporated into the gaming system 600 (FIG. 8).

The table 640 includes a camera 670 and optionally a microphone 672 that capture video and audio feeds relating to the table 640. The camera 670 is trained on the dealer 650, a play area 642, and the card handling system 660. As the game is administered by the dealer 650, the player using the user device 620 is shown the video feed captured by the camera 670 and any audio captured by the microphone 672.

The card handling system 660 is typically a shuffling device, though the card handling system 660 may also be a shoe for dispensing cards. When the game play rules require cards to be dealt, the dealer 650 obtains a card from the card handling system 660 and places the card in the appropriate location in the play area 642. The play area 642 depicts player positions and any applicable card locations for playing the same, such as shown in FIGS. 2 and 3. As determined by the rules of the game, the player at the user device 620 is presented options for responding to an event in the game using the client 622, as described with reference to FIG. 8.

The user device 620 presents the options to the player and permits the player to select an election from among the options. The election is transmitted to the table manager 648, which provides player elections to the dealer 650 using a dealer display 646 and a player action indicator 644 on the table 640. The dealer display 646 and the player action indicator 644 provide information to the dealer 650 regarding the game play and elections made by players. Using the dealer display 646, for example, the dealer 650 may obtain information regarding where to deal the next card or which player position is responsible for the next action.

In one embodiment, the table manager 648 receives card information from the card handling system 660 describing cards dealt by the card handling system 660. The card handling system 660 may include a card reader that determines card information from the card. For example, the card handling system 660 may process an image of the card, or the card handling system 660 may include a barcode reader or other system for obtaining information regarding each card. The card information may include rank and suit of each dealt card, which is obtained by the card handling system 660 and transmitted to the table manager 648. The card handling system 660 may also dispense more than one card at once or identify a set of cards dispensed together as a hand. One example card handling system 660 is described in U.S. Pat. No. 8,070,574, which is hereby incorporated by reference.

Using the card information, the table manager 648 identifies hands associated with each player and, when applicable, the dealer. The table manager 648 uses the card information and identified hands, along with the elected player decisions, to determine gameplay events and, using the rules of the game, determine wager results. Alternatively, the wager results are determined by the dealer 650 and input to the table manager 648, and the wager results may be used to confirm automatically determined results by the gaming system 600 (FIG. 8). Optionally, the card information relating to cards viewable by a player is also transmitted to the user device 620 associated with the player, permitting representations of the cards to be displayed to the user in addition to the cards viewed in the play area 642.

The live video feed permits the dealer 650 to show cards dealt by the card handling system 660 and play the game as though the player were at a live casino. In addition, the dealer 650 can prompt a user by announcing a player's election is to be performed. In embodiments in which the microphone 672 is included, the dealer 650 can verbally announce action or request an election by a player. In some embodiments, the user device 620 also includes a camera or microphone, which also captures feeds to be shared with the dealer 650 and other players.

Figure 10:
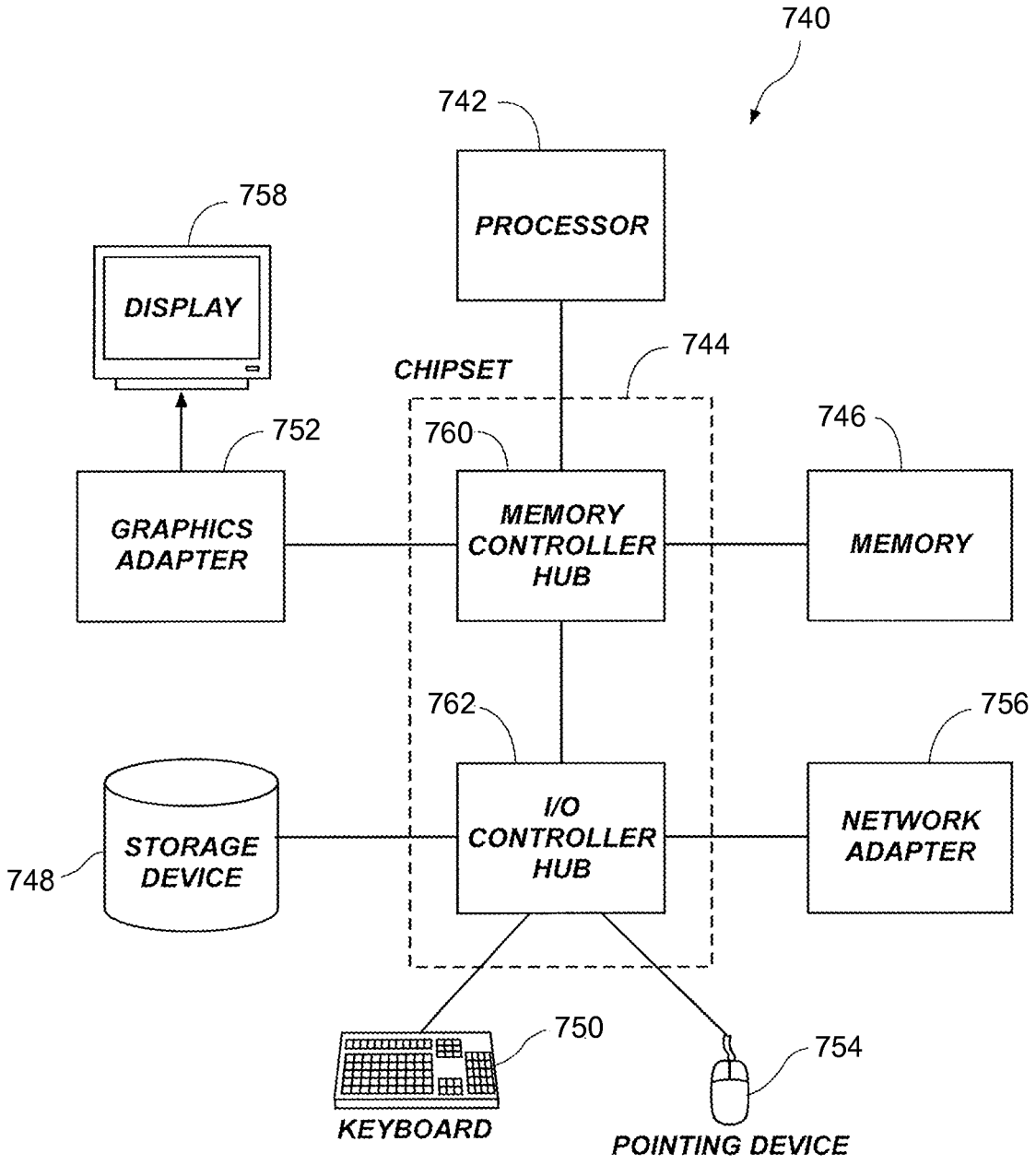
FIG. 10 is a block diagram of a computer for acting as a gaming system according to one embodiment.

Referring to FIG. 10, shown is a high-level block diagram of a computer system 740 for acting as the gaming system 600 (see FIGS. 8 and 9), according to one embodiment. Illustrated are at least one processor 742 coupled to a chipset 744, as indicated in dashed lines. Also coupled to the chipset 744 are a memory 746, a storage device 748, a keyboard 750, a graphics adapter 752, a pointing device 754, and a network adapter 756. A display 758 is coupled to the graphics adapter 752. In one embodiment, the functionality of the chipset 744 is provided by a memory controller hub 760 and an I/O controller hub 762. In another embodiment, the memory 746 is coupled directly to the processor 742 instead of to the chipset 744.

The storage device 748 is any non-transitory computer-readable storage medium, such as a hard drive, a compact disc read-only memory (CD-ROM), a DVD, or a solid-state memory device (e.g., a flash drive). The memory 746 holds instructions and data used by the processor 742. The pointing device 754 may be a mouse, a track pad, a track ball, or another type of pointing device and is used in combination with the keyboard 750 to input data into the computer system 740. The graphics adapter 752 displays images and other information on the display 758. The network adapter 756 couples the computer system 740 to a local or wide area network.

As is known in the art, the computer system 740 can have different and/or other components than those shown in FIG. 10. In addition, the computer system 740 can lack certain illustrated components. In one embodiment, the computer system 740 acting as the gaming system 600 (FIG. 8) lacks the keyboard 750, the pointing device 754, the graphics adapter 752, and/or the display 758. Moreover, the storage device 748 can be local and/or remote from the computer system 740 (such as embodied within a storage area network (SAN)). Moreover, other input devices, such as, for example, touch screens may be included.

The network adapter 756 (may also be referred to herein as a "communication device") may include one or more devices for communicating using one or more of the communication media and protocols discussed above with respect to FIG. 8.

In addition, some or all of the components of this general computer system 740 of FIG. 10 may be used as part of the processor and memory discussed above with respect to the systems of FIGS. 5, 6, and 7.

The gaming system 600 (FIG. 8) may comprise several such computer systems 740. The gaming system 600 may include load balancers, firewalls, and various other components for assisting the gaming system 600 to provide services to a variety of user devices 620 (FIGS. 8 and 9).

As is known in the art, the computer system 740 is adapted to execute computer program modules for providing functionality described herein. As used herein, the term "module" refers to computer program logic utilized to provide the specified functionality. Thus, a module can be implemented in hardware, firmware, and/or software. In one embodiment, program modules are stored on the storage device 748, loaded into the memory 746, and executed by the processor 742.

Embodiments of the entities described herein can include other and/or different modules than the ones described here. In addition, the functionality attributed to the modules can be performed by other or different modules in other embodiments. Moreover, this description occasionally omits the term "module" for purposes of clarity and convenience.

Some portions of the disclosure are presented in terms of algorithms (e.g., as represented in flowcharts, prose descriptions, or both) and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps (instructions) leading to a desired result. The steps are those requiring physical manipulations of physical quantities. Usually, though not necessarily, these quantities take the form of electrical, magnetic, or optical signals capable of being stored, transferred, combined, compared, and otherwise manipulated. It is convenient at times, principally for reasons of common usage, to refer to these signals as bits, values, elements, symbols, characters, terms, numbers, or the like. Furthermore, it is also convenient at times to refer to certain arrangements of steps requiring physical manipulations or transformation of physical quantities or representations of physical quantities as modules or code devices, without loss of generality.

However, all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing," "computing," "calculating," "determining," "displaying," or the like, refer to the action and processes of a computer system, or similar electronic computing device (such as a specific computing machine), that manipulates and transforms data represented as physical (electronic) quantities within the computer system memories or registers or other such information storage, transmission, or display devices.

Certain aspects of the embodiments include process steps and instructions described herein in the form of an algorithm. It should be noted that the process steps and instructions of the embodiments can be embodied in software, firmware, or hardware, and, when embodied in software, could be downloaded to reside on and be operated from different platforms used by a variety of operating systems. The embodiments can also be in a computer program product, which can be executed on a computing system.

Some embodiments also relate to an apparatus for performing the operations herein. Such an apparatus may be specially constructed for the purposes, e.g., a specific computer, or it may comprise a general-purpose computer selectively activated or reconfigured by a computer program stored in the computer. Such a computer program may be stored in a computer-readable storage medium, such as, but not limited to, any type of disk including floppy disks, optical disks, CD-ROMs, magnetic-optical disks, read-only memories (ROMs), random access memories (RAMs), EPROMs, EEPROMs, magnetic or optical cards, application specific integrated circuits (ASICs), or any type of media suitable for storing electronic instructions, and each coupled to a computer system bus. Memory can include any of the above and/or other devices that can store information/data/programs and can be a transient or non-transient medium, where a non-transient or non-transitory medium can include memory/storage that stores information for more than a minimal duration. Furthermore, the computers referred to in the specification may include a single processor or may be architectures employing multiple processor designs for increased computing capability.

The algorithms and displays presented herein are not inherently related to any particular computer or other apparatus. Various general-purpose systems may also be used with programs in accordance with the teachings herein, or it may prove convenient to construct more specialized apparatus to perform the method steps. The structure for a variety of these systems will appear from the description herein. In addition, the embodiments are not described with reference to any particular programming language. It will be appreciated that a variety of programming languages may be used to implement the teachings of the embodiments as described herein, and any references herein to specific languages are provided for the purposes of enablement and best mode.

While certain illustrative embodiments have been described in connection with the figures, those of ordinary skill in the art will recognize and appreciate that embodiments encompassed by the disclosure are not limited to those embodiments explicitly shown and described herein. Rather, many additions, deletions, and modifications to the embodiments described herein may be made without departing from the scope of embodiments encompassed by the disclosure, such as those hereinafter claimed, including legal equivalents. In addition, features from one disclosed embodiment may be combined with features of another disclosed embodiment while still being within the scope of the disclosure, as contemplated by the inventor.

The invention claimed is:

1. A method of administering a wagering game over a network, comprising:

providing a game server and a user interaction server of a gaming system;

providing, by the user interaction server, a client for execution on a user device connected to the network and associated with a player, the user device being remote from the game server;

the client receiving from the user device, and communicating to the game server, an indication of an ante wager and a bonus wager to enter the player to participate in the wagering game;

the game server determining a set of player cards including five randomized playing cards from a set of playing cards;

the game server communicating to the user interaction server the set of player cards;

the user interaction server communicating to the user device the set of player cards for display on the user device;

the game server determining a set of dealer cards including six randomized playing cards from the set of playing cards;

the game server receiving from the client, a game play election selected from a fold election and a play wager election, an amount of a play wager associated with the play wager election being at least equal to the ante wager;

the game server determining a best player four-card poker hand using the set of player cards;

the game server determining a best dealer four-card poker hand using the set of dealer cards;

the gaming system adding to a game pot any received wagers of the play wager, the ante wager, and the bonus wager;

the game server resolving the ante wager and the bonus wager, comprising:

the game server comparing the best player four-card poker hand to the best dealer four-card poker hand; and the game server determining at least a portion of the game pot to be distributed from the game pot to the player based upon the occurrence of a predetermined event.

2. The method of claim 1:

further comprising, before the client receiving from the user device, and communicating to the game server, an indication of an ante wager and a bonus wager, providing virtual wagering elements to the player associated with the user device; and wherein the client receiving from the user device, and communicating to the game server, the indication of an ante wager and a bonus wager comprises the client receiving from the user device the indication of the ante wager, the ante wager being of an amount of the virtual wagering elements.

3. The method of claim 2, wherein providing virtual wagering elements to the player associated with the user device comprises providing play-for-fun credits to the player associated with the user device.

4. The method of claim 2, further comprising awarding a quantity of the virtual wagering elements to the player associated with the user device based on a hierarchy of players.

5. The method of claim 1, further comprising:

the client receiving from the user device, and communicating to the game server, an indication of a poker wager;

the gaming system adding the poker wager to a poker pot; and the game server identifying a winner of the poker pot, the winner of the poker pot being a player, of a plurality of players including the player associated with the user device, holding a highest-ranking hand in a round of the wagering game.

6. The method of claim 5, wherein the poker pot has no house advantage.

7. The method of claim 1, further comprising:

the client receiving from the user device, and communicating to the game server, an indication of a super bonus wager; and the gaming system adding the super bonus wager to the game pot.

8. The method of claim 1, further comprising the gaming system collecting a rake on the any received wagers added to the game pot.

9. The method of claim 1, wherein the game server determining at least a portion of the game pot to be distributed from the game pot to the player based upon the occurrence of a predetermined event comprises the game server determining at least the portion of the game pot to be distributed from the game pot to the player based on a predetermined event of the best player four-card poker hand meeting a qualifying hand or better.

10. A system for managing play of a wagering game, comprising:

a user interaction server in communication between a user device of a plurality of user devices and a game server of the system, the user devices of the plurality being remote from the game server of the system, the system defining and configured to execute instructions; and a set of the instructions stored in a non-transitory computer-readable storage medium of a storage device of the system, the set of instructions configured to, when executed by the system, cause the user interaction server to:

receive, from the user device, an indication of an ante wager and a bonus wager to enter a player associated with the user device to participate in the wagering game;

receive, from the game server, a set of player cards including five randomized playing cards from a set of playing cards;

provide the set of player cards to the user device for display on the user device;

receive, from the game server, a set of dealer cards including six randomized playing cards from the set of playing cards;

receive, from the user device, a game play election selected at the user device from the group consisting of a fold election and an indication for a play wager, the play wager being of an amount at least equal to an amount of the ante wager;

receive, from the game server, a best four-card poker player hand for the player associated with the user device, the best four-card poker player hand using the set of player cards;

provide the set of dealer cards to the user device for display on the user device;

receive, from the game server, a best four-card poker dealer hand using the set of dealer cards;

receive, from the game server, game outcomes resolving each wager of the ante wager, the bonus wager, and the play wager for which a respective indication was received;

add to a game pot each of the ante wager, the bonus wager, and the play wager for which the respective indication was received;

provide the game outcomes to the user device for display on the user device; and award at least a portion of the game pot to the player upon the occurrence of a predetermined event.

11. The system of claim 10, wherein the set of instructions is further configured to, when executed by the system, cause the game server to determine the game outcomes resolving each wager of the ante wager, the bonus wager, and the play wager for which the respective indication was received, the game outcomes comprising a game outcome resolving the ante wager based at least in part on a comparison, by the game server, of the best four-card poker player hand to the best four-card poker dealer hand; and a game outcome resolving the play wager based at least in part on the comparison, by the game server, of the best four-card poker player hand to the best four-card poker dealer hand.

12. The system of claim 10, wherein the set of the instructions, when executed by the system, further cause the user interaction server to provide a quantity of the virtual wagering elements to the plurality of user devices based on a hierarchy of players associated with the plurality of user devices, the plurality of players including the player associated with the user device.

13. The system of claim 10, wherein the set of instructions configured to, when executed by the system, cause the game server to award at least a portion of the game pot to the player upon the occurrence of a predetermined event comprises the set of instructions configured to, when executed by the system, cause the game server to award the game pot to the player upon the occurrence of the predetermined event.

14. The system of claim 10, wherein the set of instructions is further configured to, when executed by the system:

cause the user interaction server to:

receive, from the user device, an indication of a poker wager; and communicate, to the game server, the indication of the poker wager; and cause the game server to:

add the poker wager to a poker pot; and allocate the poker pot to one of a plurality of players, associated with the plurality of user devices and including the player associated with the user device, the one being associated with a highest-ranking hand in a round of play of the wagering game.

15. The system of claim 10, wherein the set of instructions is further configured to, when executed by the system, cause the game server to add to the game pot a super bonus wager, received from the user device via the user interaction server.

16. The system of claim 10, wherein the predetermined event is selected from the group consisting of a predetermined number of hands, a predetermined number of rounds, a predetermined time limit, and a predetermined amount in the game pot.

17. The system of claim 10, wherein the game pot is a progressive pot.

* * * * *